US010524593B2

(12) United States Patent
Khan

(10) Patent No.: US 10,524,593 B2
(45) Date of Patent: Jan. 7, 2020

(54) ARTICLE OF BEDDING

(71) Applicant: Amer Habib Khan, Streamwood, IL (US)

(72) Inventor: Amer Habib Khan, Streamwood, IL (US)

( * ) Notice: Subject to any disclaimer, the term of this patent is extended or adjusted under 35 U.S.C. 154(b) by 0 days.

(21) Appl. No.: 15/217,811

(22) Filed: Jul. 22, 2016

(65) Prior Publication Data

US 2016/0324342 A1 Nov. 10, 2016

Related U.S. Application Data

(63) Continuation-in-part of application No. 14/520,123, filed on Oct. 21, 2014, and a continuation-in-part of application No. 13/753,468, filed on Jan. 29, 2013, now Pat. No. 8,898,835.

(60) Provisional application No. 61/946,552, filed on Feb. 28, 2014, provisional application No. 61/596,114, filed on Feb. 7, 2012.

(51) Int. Cl.
*A47G 9/08* (2006.01)
*A47G 9/02* (2006.01)

(52) U.S. Cl.
CPC ..... *A47G 9/0223* (2013.01)

(58) Field of Classification Search
CPC .. A47G 9/0223; A47G 9/0238; A47G 9/0246; A47G 9/0261; A47G 9/08
USPC ..... 5/482, 486, 494–499
See application file for complete search history.

(56) References Cited

U.S. PATENT DOCUMENTS 2,627,617 A * 2/1953 Avila ..... A47G 9/0238 5/494
2,789,292 A * 4/1957 Budinquest ..... A47D 15/02 5/486
4,161,044 A * 7/1979 Bogle ..... A47G 9/02 5/494
5,003,655 A * 4/1991 Kafai ..... A47G 9/0238 5/484
5,566,411 A * 10/1996 Eiler ..... A47G 9/02 5/484
5,732,424 A * 3/1998 Bond ..... A47G 9/02 5/498
5,943,717 A * 8/1999 Alexander ..... A47G 9/023 5/482

* cited by examiner

*Primary Examiner* — Fredrick C Conley
(74) *Attorney, Agent, or Firm* — Patent Service Associates, Inc.; Lyman Smith

(57) ABSTRACT

A fitted blanket fits over the mattress and secures underneath to prevent the blanket from moving off the user while sleeping in bed. The blanket can include an elastic material on at least the underside corner edges thereof to help secure the blanket to the mattress. The fitted blanket includes an opening to allow for easy entry and exit, rather than having to untuck the blanket. The opening may also provide an easy way to make the bed. The opening may simply be designed like a cut in the blanket and may or may not include closing mechanisms. The fitted nature of the blanket prevents blanket slippage or movement. The blanket may further include a cut-out region or an opening along at least a portion of the head end for pillow placement. The blanket can also include glow-in-the-dark elements or illuminated elements to light up the blanket at night.

26 Claims, 39 Drawing Sheets

ARTICLE OF BEDDING

CROSS-REFERENCE TO RELATED APPLICATIONS

This application in a continuation-in-part of U.S. patent application Ser. No. 14/520,123, filed Oct. 21, 2014, currently pending, which claims the benefit of U.S. provisional application No. 61/946,522 filed Feb. 28, 2014 and which is also is a continuation-in-part of U.S. Patent application Ser. No. 13/753,468, filed Jan. 29, 2013, now U.S. Pat. No. 8,898,835, which claims the benefit of U.S. provisional patent application No. 61/596,114, filed Feb. 7, 2012, the contents of each of which are herein incorporated by reference.

BACKGROUND OF THE INVENTION

The present invention relates to articles of bedding and, more particularly, to a fitted blanket having an optionally closable opening extending from the head end toward a foot end of the fitted blanket.

Blankets, as currently marketed, are simply laid over the mattress or could be tucked under a mattress. Either way, these methods cannot assure the blanket will stay on the bed and on top of the user. There are currently no blankets on the market that prevent the blanket from coming untucked and loose, or from falling away from the user. There are also no blankets on the market that allow for easy access in order to easily get in or out of the bed.

Conventional blankets often move off a child or adult while sleeping in bed. In addition to not serving their function in covering up a person in bed, these blankets may fall away from the bed during the night, making it even more difficult to cover back up. Parents need to regularly pull up a blanket many times during the course of a night to keep a child covered.

Moreover, conventional blankets can be difficult to make up on the bed, especially when this job rests with the child.

As can be seen, there is a need for an improved blanket that can stay on the bed an in its proper position while providing a means of entry and exit from the bed.

SUMMARY OF THE INVENTION

In one aspect of the present invention, an article of bedding comprises a bedding material adapted to fit on a mattress, the mattress having a head end and a foot end; a head opening along at least a portion of the head end of the mattress when the bedding material is disposed on the mattress; and at least one side opening extending toward the foot end of the mattress when the bedding material is disposed on the mattress. and may even extend all the way to the foot end thereof.

In another aspect of the present invention, an article of bedding comprises a bedding material adapted to fit on a mattress, the mattress having a head end and a foot end, the bedding material formed from a single layer of bedding material; a head opening along at least a portion of the head end of the mattress when the bedding material is disposed on the mattress; at least one side opening extending toward the foot end of the mattress when the bedding material is disposed on the mattress. and may even extend all the way to the foot end thereof; and at least one flap extending at least in a region adjacent the side opening toward a surface supporting the mattress.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a fitted blanket that fits over the mattress and secures underneath to prevent the blanket from moving off the user while sleeping in bed. The blanket can include an elastic material on at least the underside corner edges thereof to help secure the blanket to the mattress. The fitted blanket may further include an opening to allow for easy entry and exit, rather than having to untuck the blanket, as is the case with conventional blankets. The opening may also provide an easy way to make the bed. The opening may simply be designed like a cut in the blanket and may or may not include closing mechanisms. The fitted nature of the blanket prevents blanket slippage or movement. The blanket may further include a cut-out region or an opening along at least a portion of the head end for pillow placement. The blanket can also include glow-in-the-dark elements or illuminated elements to light up the blanket at night.

Figure 1:
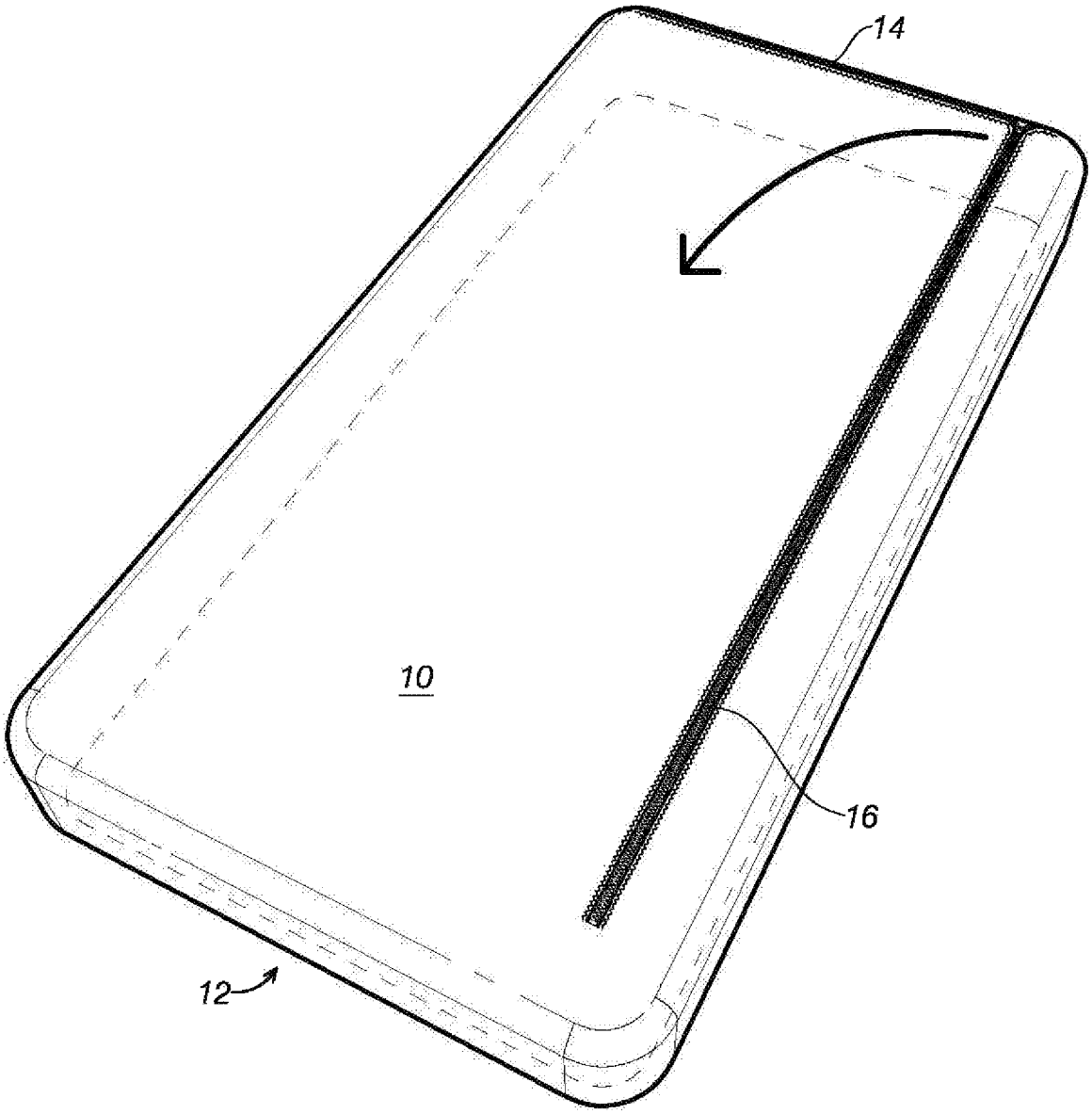
FIG. 1 is a perspective view of an article of bedding having a closure along one side thereof, according to an exemplary embodiment of the present invention, disposed on a mattress.

Referring now to FIG. 1, an article of bedding 10 (also referred to as bedding 10 or blanket 10) can fit over a mattress 12, typically extending over both the top and the sides thereof. The bedding 10 can include a head opening 14 along at least a portion of the head end. In some embodiments, the head opening 14 can be a slit cut along the head end of the bedding 10. In some embodiments, the head opening 14 can extend along the entire width of the head end of the mattress 12.

A side opening 16 can extend from the head opening 14 toward the foot end of the bedding 10. Typically, the side opening 16 can be disposed along the top of the mattress 12 (when the bedding 10 is disposed on the mattress 12), running adjacent to the side of the mattress 12. In some embodiments, the side opening 16 can be disposed from about 1 to about 12 inches inward from a side of the mattress 12.

Figure 1A:
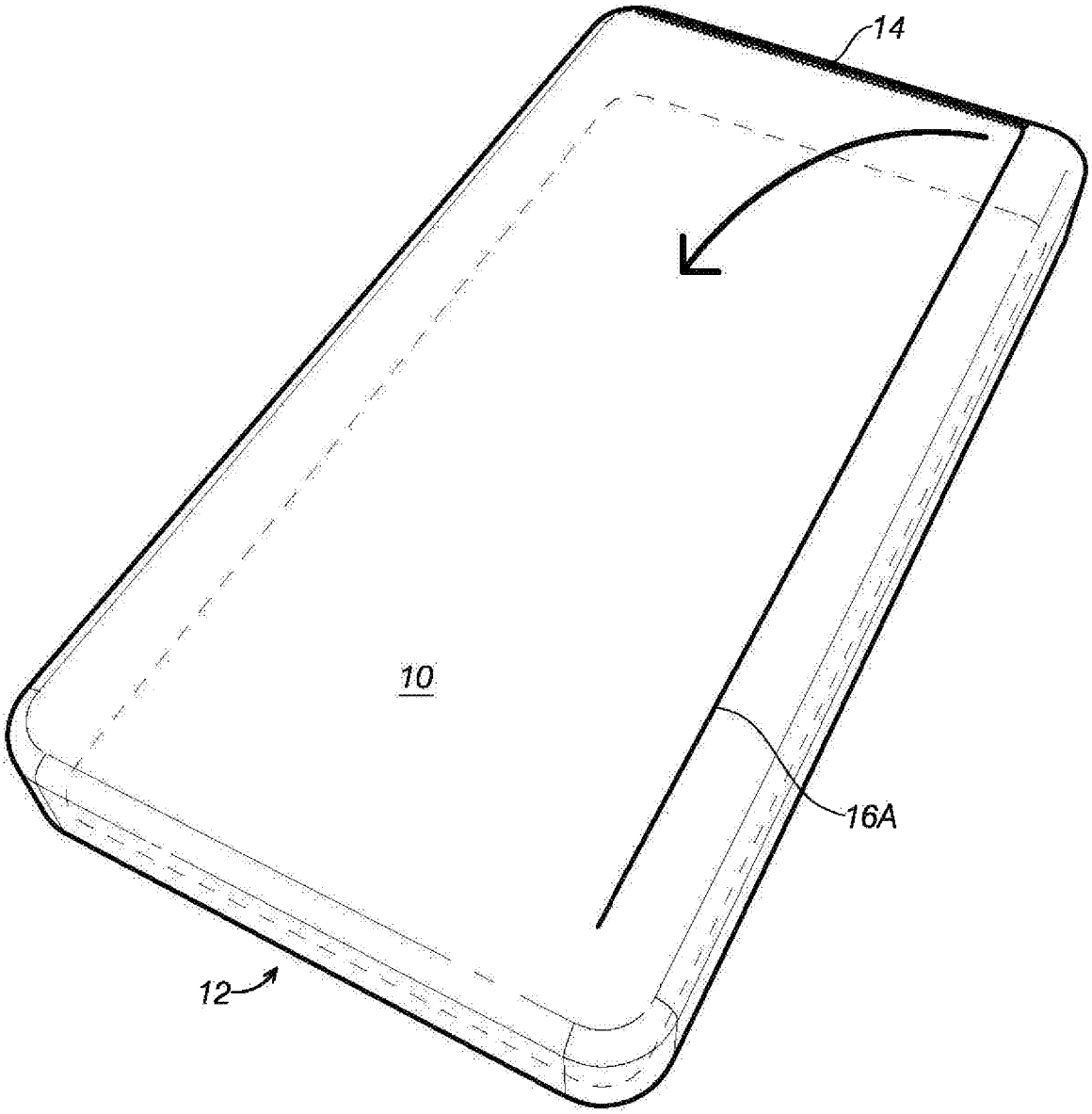
FIG. 1A is a perspective view of an article of bedding having a slit opening along one side thereof, according to an exemplary embodiment of the present invention, disposed on a mattress.

The side opening 16 may extend along one or both sides of the mattress 12 when the bedding 10 is disposed thereupon. The side opening 16 can extend toward the foot end of the bed and may even extend all the way to the foot end thereof. As shown in FIG. 1A, the side opening 16 can be designed as a slit opening 16A in the bedding 10, for example. Of course, the slit opening 16A may include various types of edging, such as stitching, folded over fabric, or the like, as may be known in the art.

In some embodiments, the side opening 16 can be a closable opening. Various closing mechanisms can be used to close the opening 16. For example, the side opening 16 can be closed with a zipper, snaps, buttons, hook and loop fastener, or the like. The closure for the closable opening may be disposed for access from inside the bedding 10, from outside the bedding 10, or from both the inside and outside.

Figure 2:
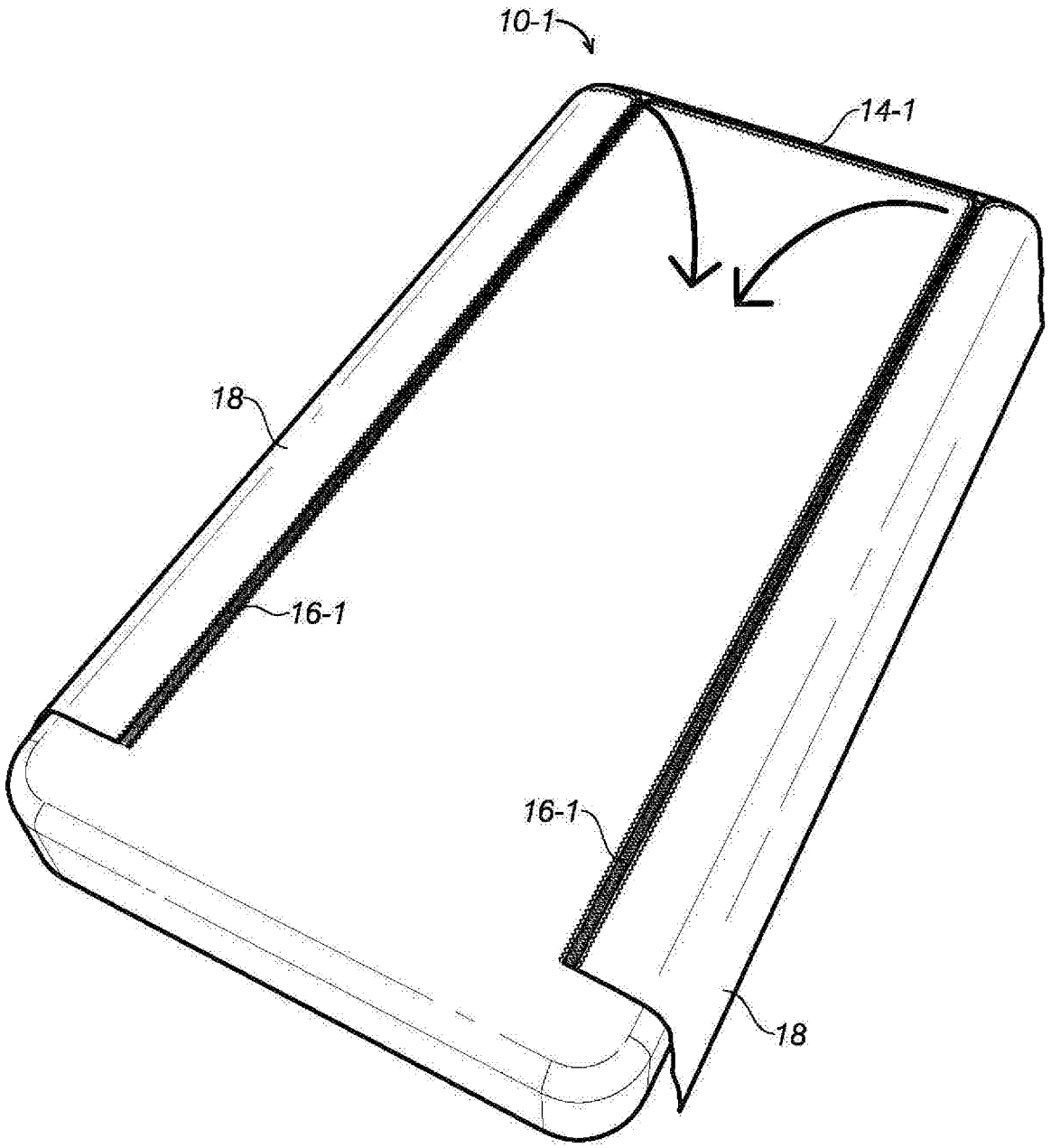
FIG. 2 is a perspective view of an article of bedding having an exposed closure mechanism on each side thereof with flaps along the sides extending toward the floor, according to another exemplary embodiment of the present invention, disposed on a mattress.

Referring now to FIG. 2, in another embodiment of the present invention, bedding 10-1 can similar to the bedding 10 of FIG. 1, with one or more side openings 16-1 along each side from a head end opening 14-1. In the embodiment of FIG. 2, however, one or more flaps 18 can be disposed to extend from one or more sides of the bedding 10-1 to extend along the side of the mattress 12 toward a floor. In some embodiments, the flaps 18 can extend around to include the foot end of the mattress 12.

Figure 2A:
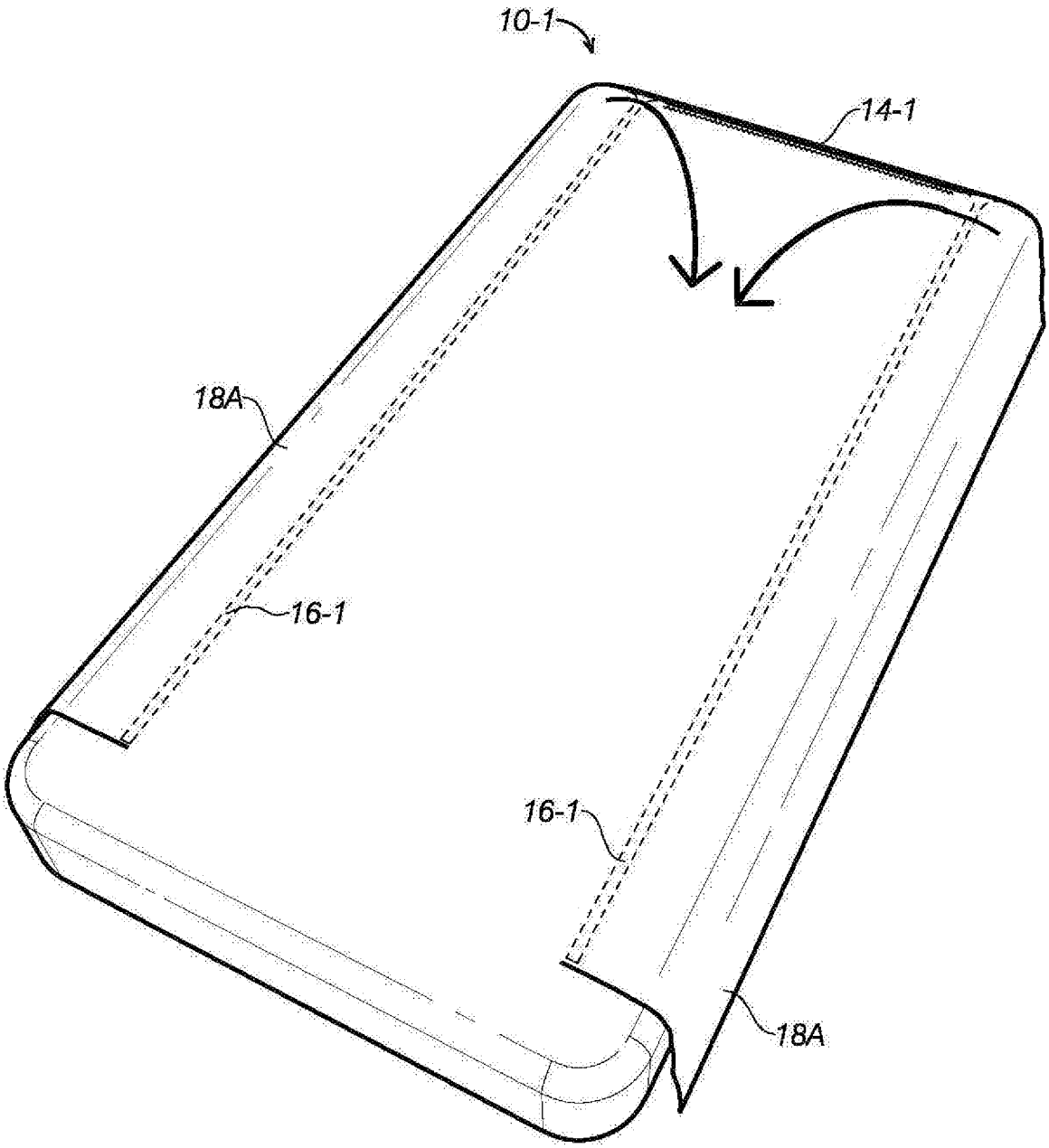
FIG. 2A is a perspective view of an article of bedding having a covered closure mechanism on each side thereof with flaps along the sides extending toward the floor, according to another exemplary embodiment of the present invention, disposed on a mattress.

As shown in FIG. 2A, one or more flaps 18A can be disposed to cover the side openings 16-1, as shown by phantom lines in the Figure. To use the bedding 10-1 of FIG. 2A, the user can lift a flap and open one or both of the side openings 16-1 to get under the bedding 10-1. The user can then close the side openings 16-1 to secure the bedding 10-1 over the user. Similar to the above embodiments, the side openings 16-1 can be a closable opening. Various closing mechanisms can be used to close the side openings 16-1. For example, the side openings 16-1 can be closed with a zipper, snaps, buttons, hook and loop fastener, or the like.

Figure 2B:
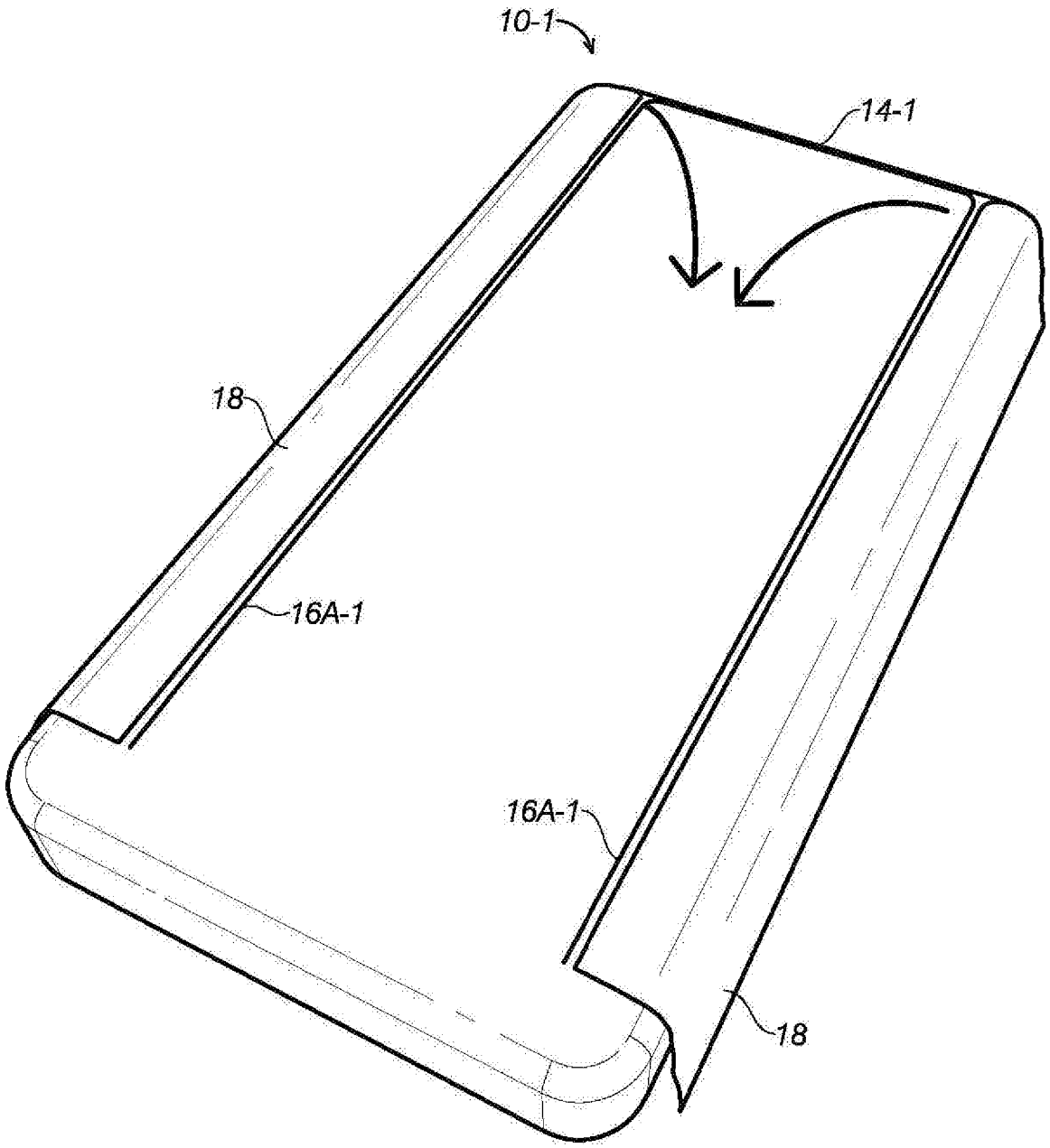
FIG. 2B is a perspective view of an article of bedding having an exposed slit opening on each side thereof with flaps along the sides extending toward the floor, according to another exemplary embodiment of the present invention, disposed on a mattress.
Figure 2C:
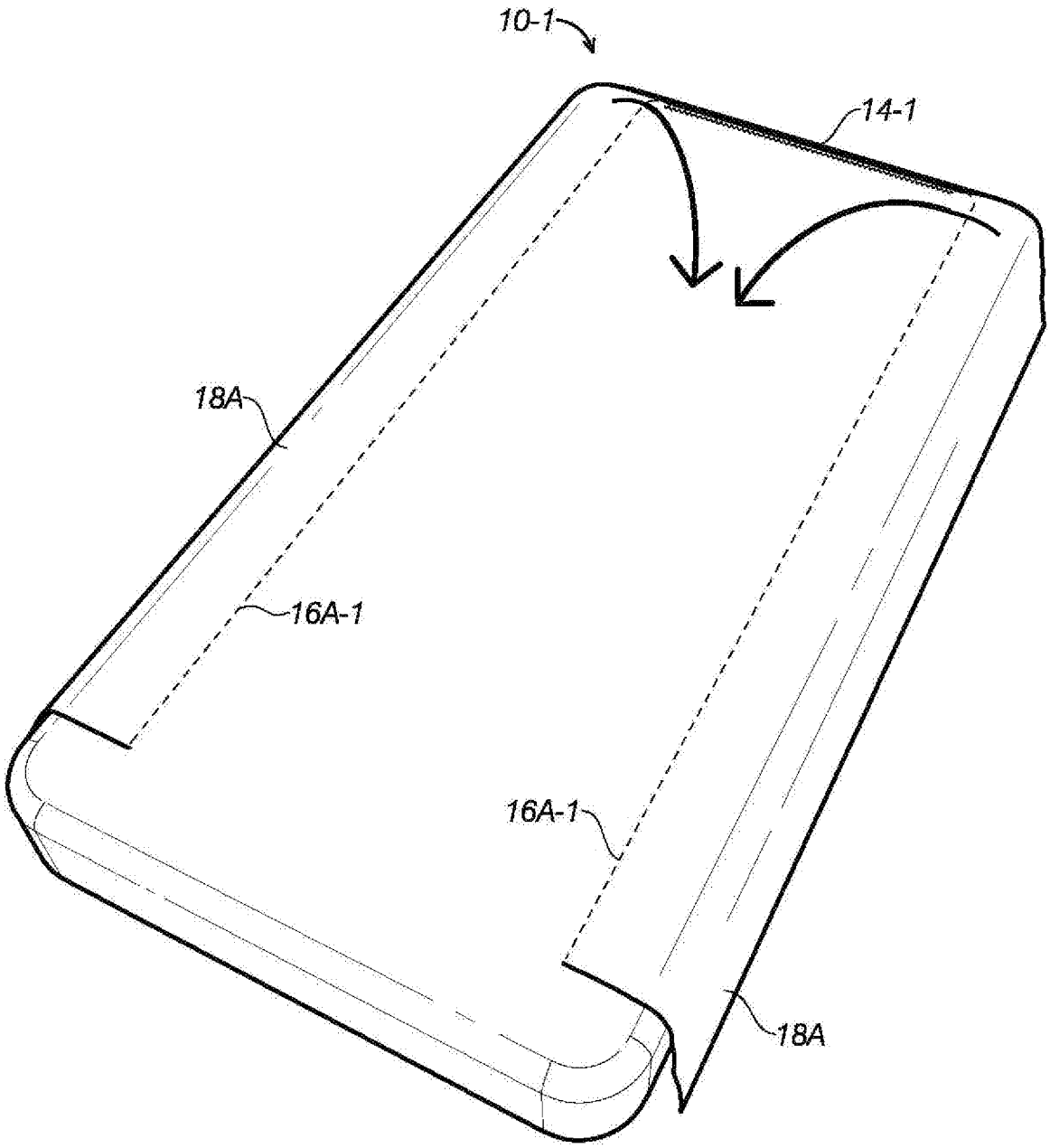
FIG. 2C is a perspective view of an article of bedding having a covered slit opening on each side thereof with flaps along the sides extending toward the floor, according to another exemplary embodiment of the present invention, disposed on a mattress.

Referring now to FIGS. 2B and 2C, in place of the closable side openings 16-1, a slit opening 16A-1 may be disposed along both sides of the bedding 10-1. The slit openings 16A-1 may be exposed, as shown in FIG. 2B, or may be covered by the flaps 18A, as shown in FIG. 2C.

Figure 2D:
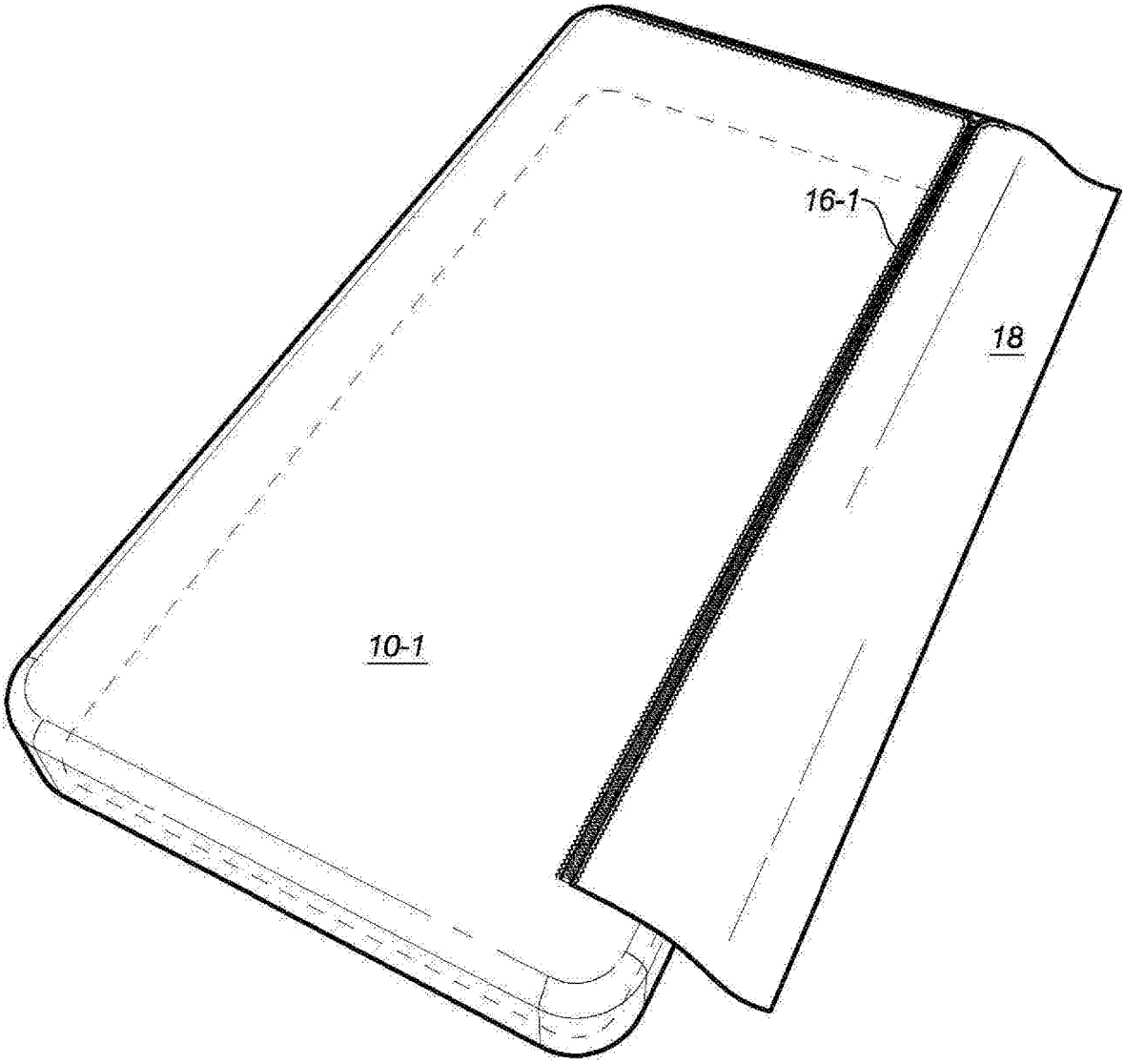
FIG. 2D is a perspective view of an article of bedding having an exposed closure mechanism on one side thereof with a flap along the same side extending toward the floor, according to another exemplary embodiment of the present invention, disposed on a mattress.
Figure 2E:
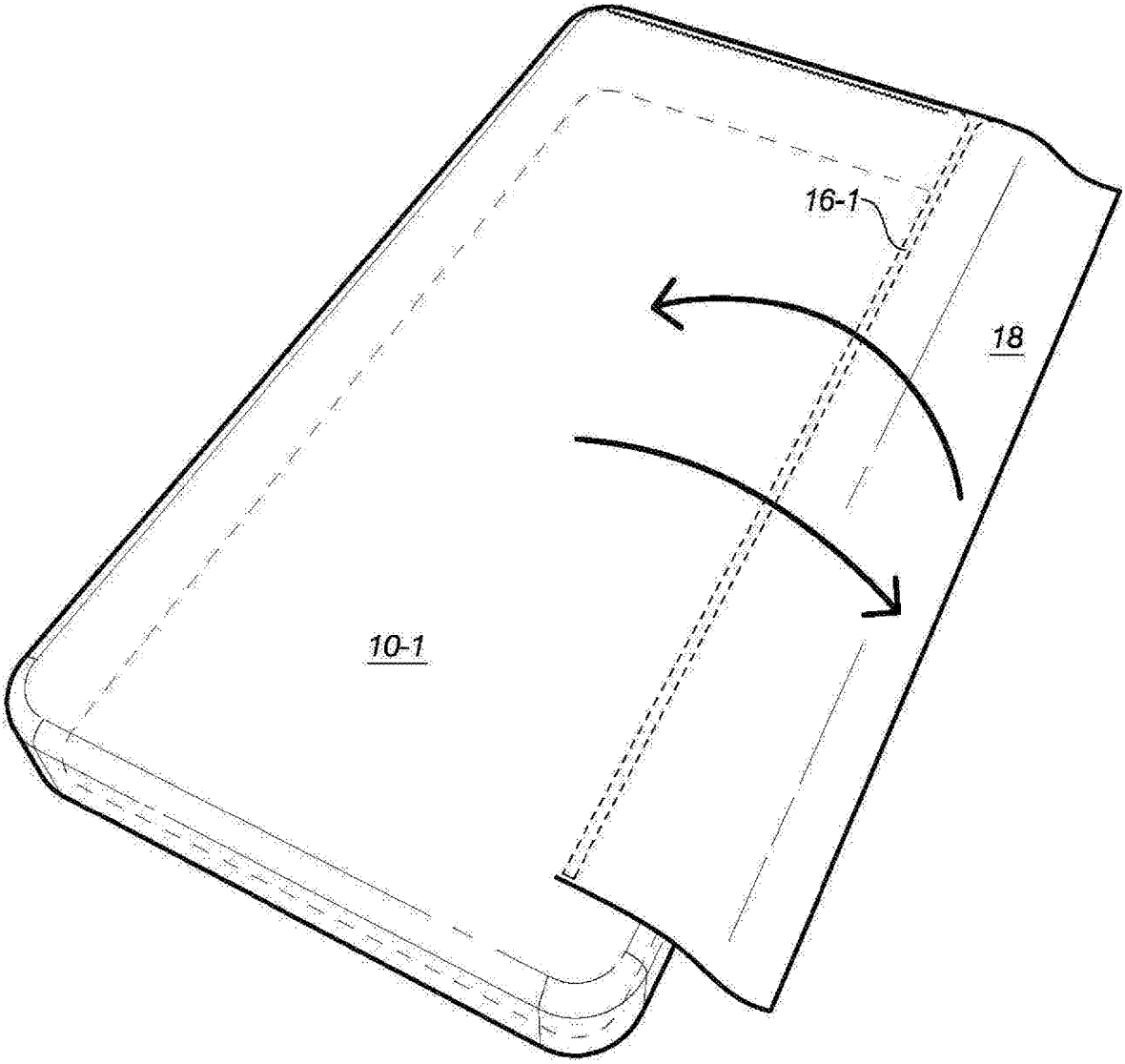
FIG. 2E is a perspective view of an article of bedding having a covered closure mechanism on one side thereof with a flap along the same side extending toward the floor, according to another exemplary embodiment of the present invention, disposed on a mattress.

In some embodiments, as shown in FIG. 2D and FIG. 2E, a single side opening 16-1 may be disposed along a side of the bedding 10-1 and a single flap 18 can be disposed along the same side. While the Figures show the flap being the same size as the side opening 16-1, the flap may be different sizes and may extend to the foot of the bed. The side opening 16-1 may be exposed, as shown in FIG. 2D, or may be covered by the flap 18, as shown in FIG. 2E.

Figure 2F:
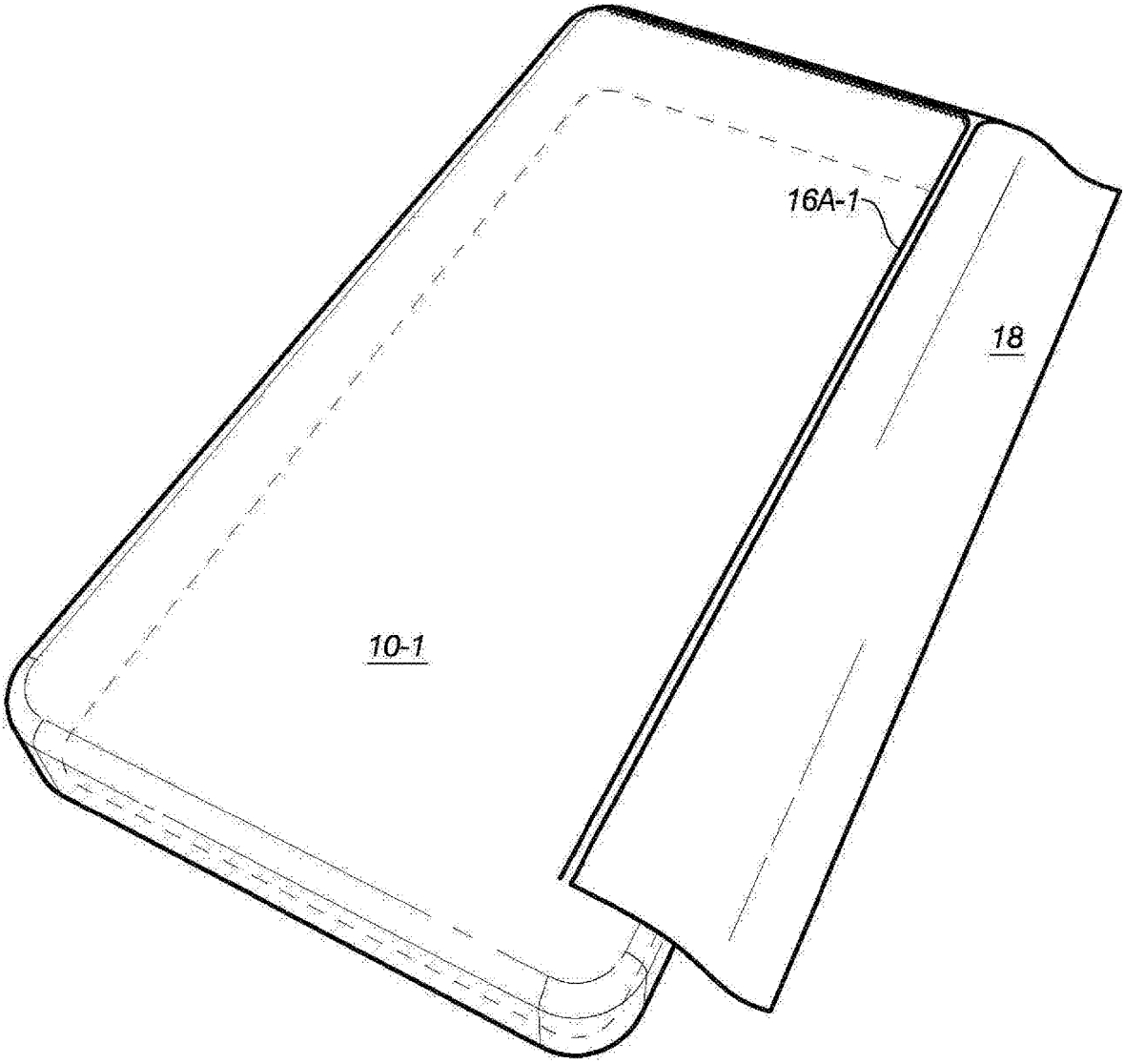
FIG. 2F is a perspective view of an article of bedding having an exposed slit opening on one side thereof with a flap along the same side extending toward the floor, according to another exemplary embodiment of the present invention, disposed on a mattress.
Figure 2G:
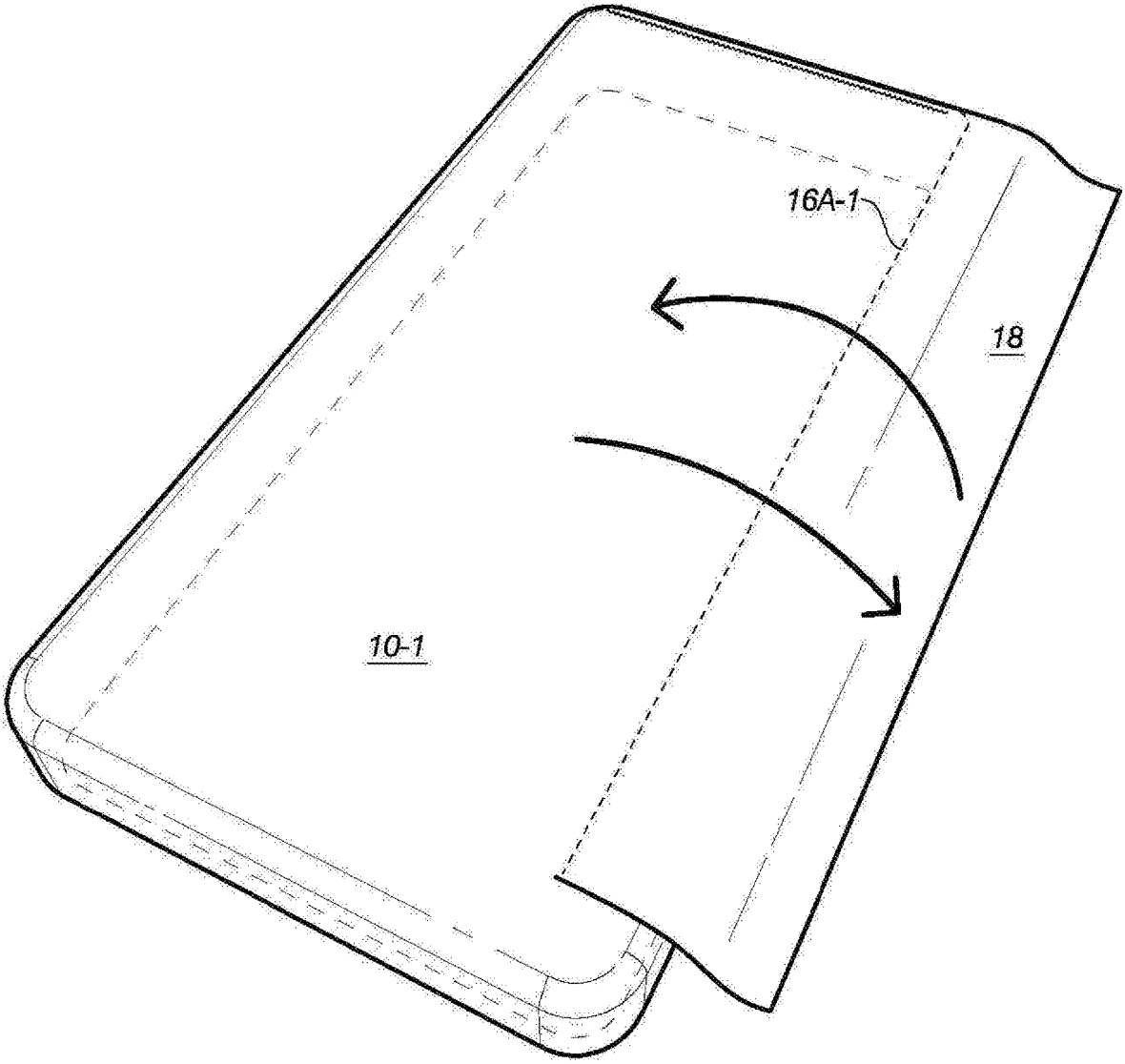
FIG. 2G is a perspective view of an article of bedding having a covered slit opening on one side thereof with a flap along the same side extending toward the floor, according to another exemplary embodiment of the present invention, disposed on a mattress.

Referring now to FIGS. 2F and 2G, in place of the closable side openings 16-1, a slit opening 16A-1 may be disposed along one side of the bedding 10-1 and a single flap 18 can be disposed along the same side. While the Figures show the flap being the same size as the side opening 16-1, the flap may be different sizes and may extend to the foot of the bed. The slit opening 16A-1 may be exposed, as shown in FIG. 2F, or may be covered by the flaps 18, as shown in FIG. 2G.

Figure 3:
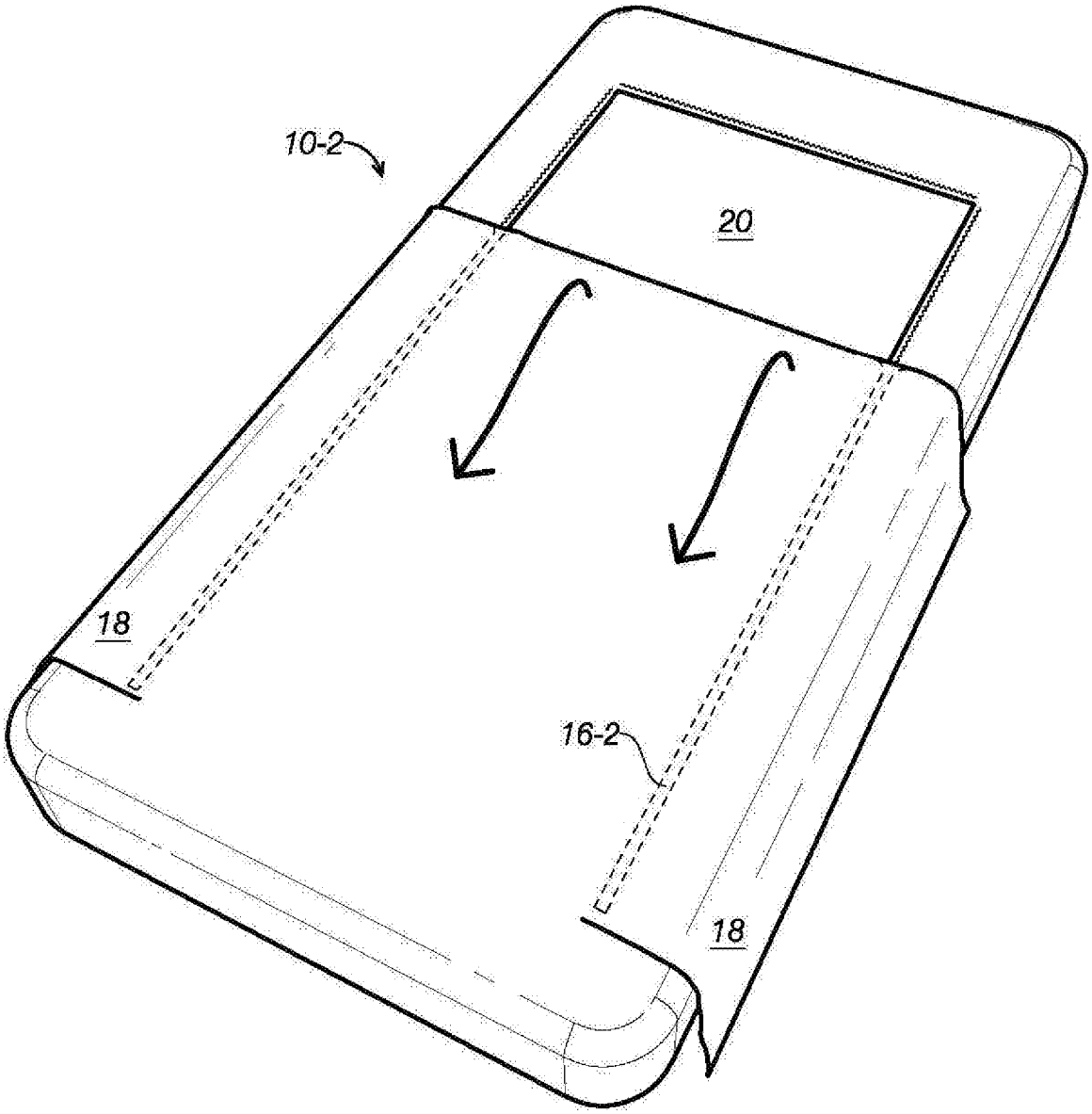
FIG. 3 is a perspective view of an article of bedding having a head opening and a covered closure mechanism on each side of the article of bedding with flaps along the sides extending toward the floor, according to another exemplary embodiment of the present invention, disposed on a mattress.
Figure 3A:
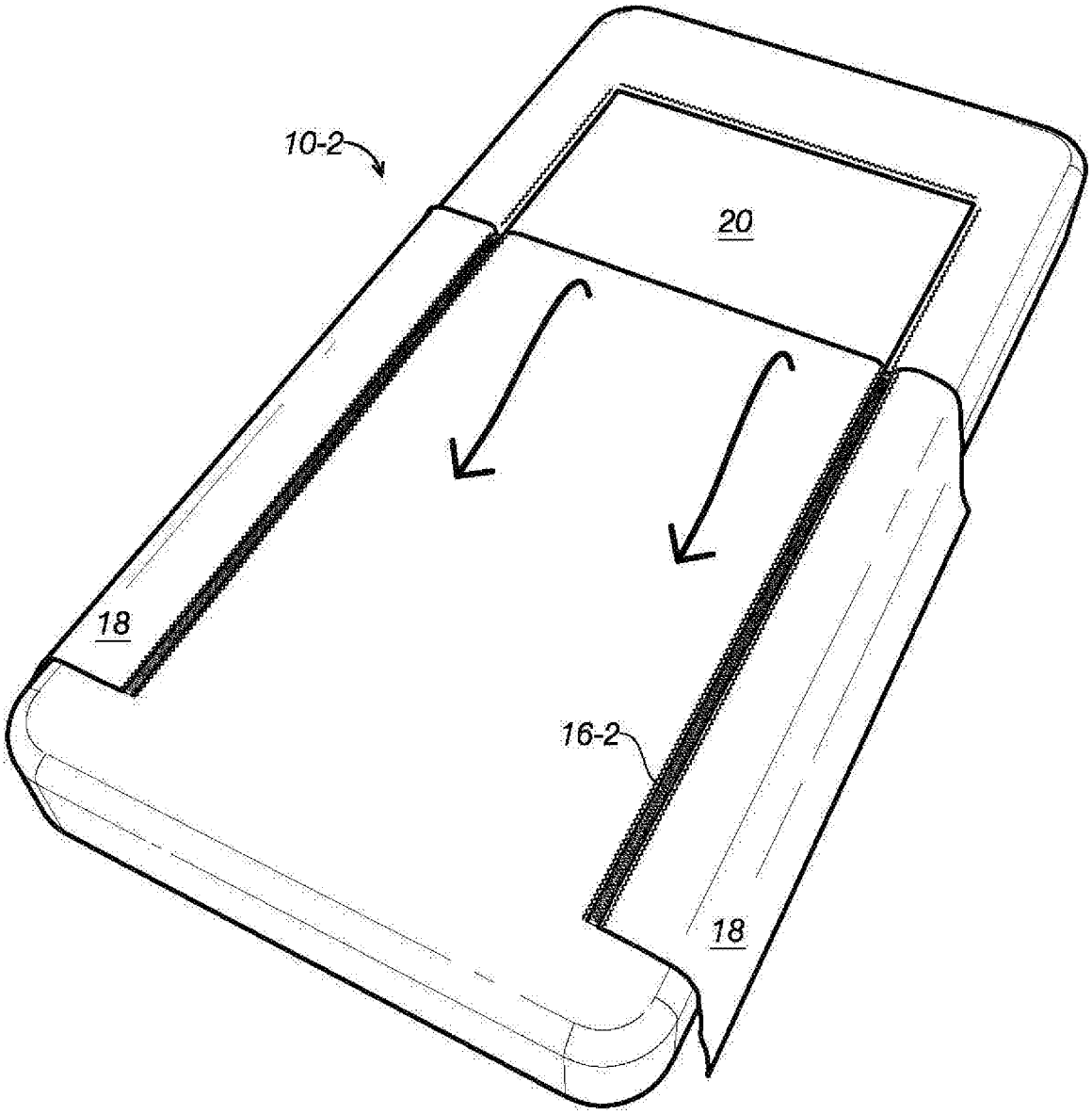
FIG. 3A is a perspective view of an article of bedding having a head opening and an exposed closure mechanism on each side of the article of bedding with flaps along the sides extending toward the floor, according to another exemplary embodiment of the present invention, disposed on a mattress.

Referring now to FIGS. 3 and 3A, bedding 10-2 can include an opening 20 at the head end of the mattress. The opening 20 can be formed in the bedding 10-2 in various sizes, from just a slit-like opening, to an opening having a geometric or non-geometric shape. For example, as shown in FIGS. 3 and 3A, the opening 20 may be formed in a generally rectangular shape in the general location where a pillow may be placed.

Figure 3B:
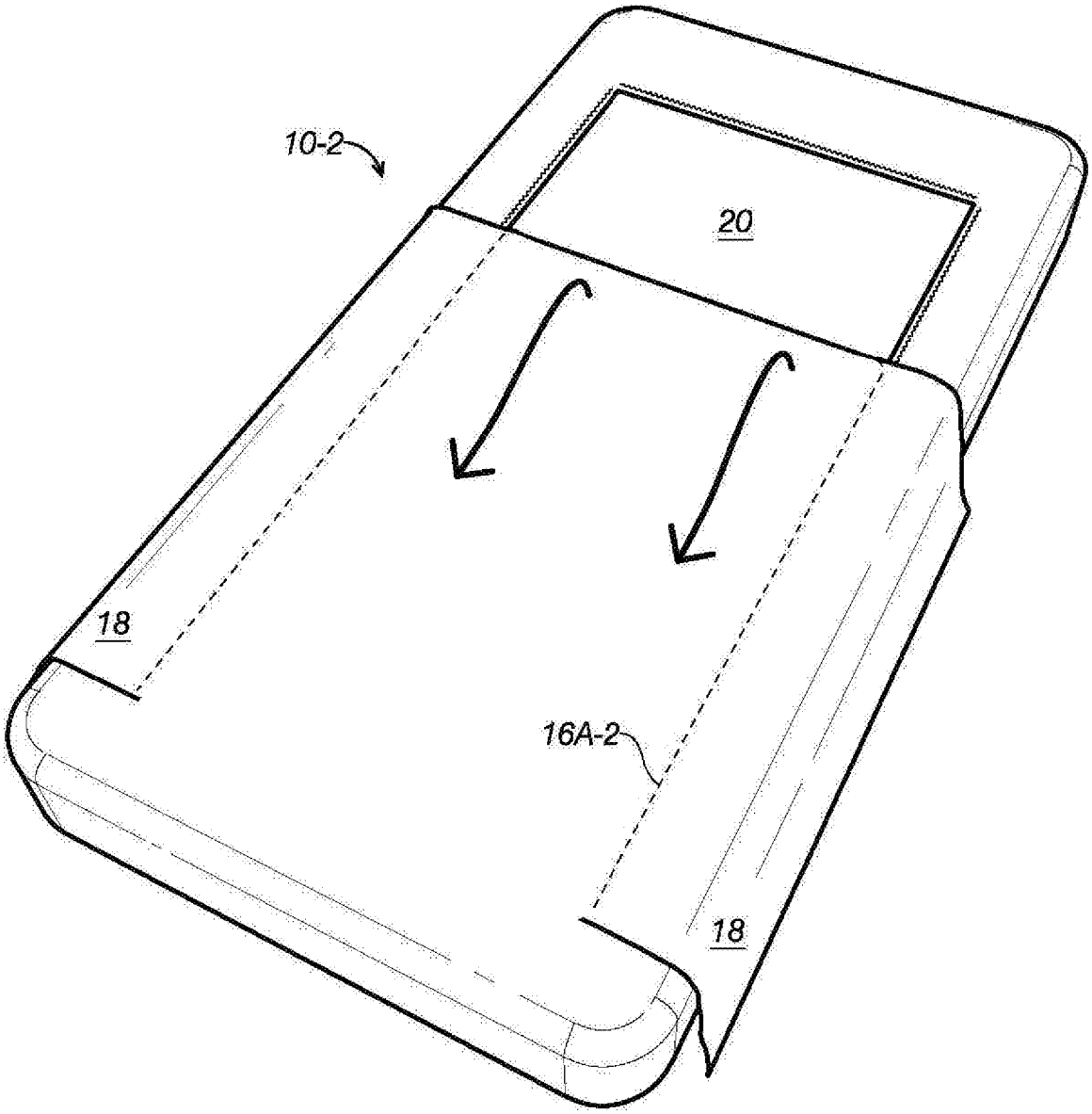
FIG. 3B is a perspective view of an article of bedding having a head opening and a covered slit opening on each side of the article of bedding with flaps along the sides extending toward the floor, according to another exemplary embodiment of the present invention, disposed on a mattress.

Two flaps 18 may extend down sides of the bedding 10-2. From the opening 20 may be formed one or more side openings 16-2 extending toward a foot end of the bedding 10-2. The side openings 16-2 may allow a user to fold down a portion of the bedding, get into the bed and pull the bedding back up over them. As described above, the flaps 18 cover the side opening 16-2 (as shown in FIG. 3B) or may be disposed as a decorative feature extending down the side of the bedding 10-2 (as shown in FIG. 3). This decorative feature may be disposed along the bedding 10-2 to act similar to a bed skirt and may be present in addition to the flaps 18 that cover the side opening 16-2. The flaps 18 may be formed in various lengths and widths. For example, the width of the flaps 18 may be narrow to provide minimal overlap with the bedding 10-2, or may be wide to extend along one or more of the sides of the mattress toward the floor.

Figure 3C:
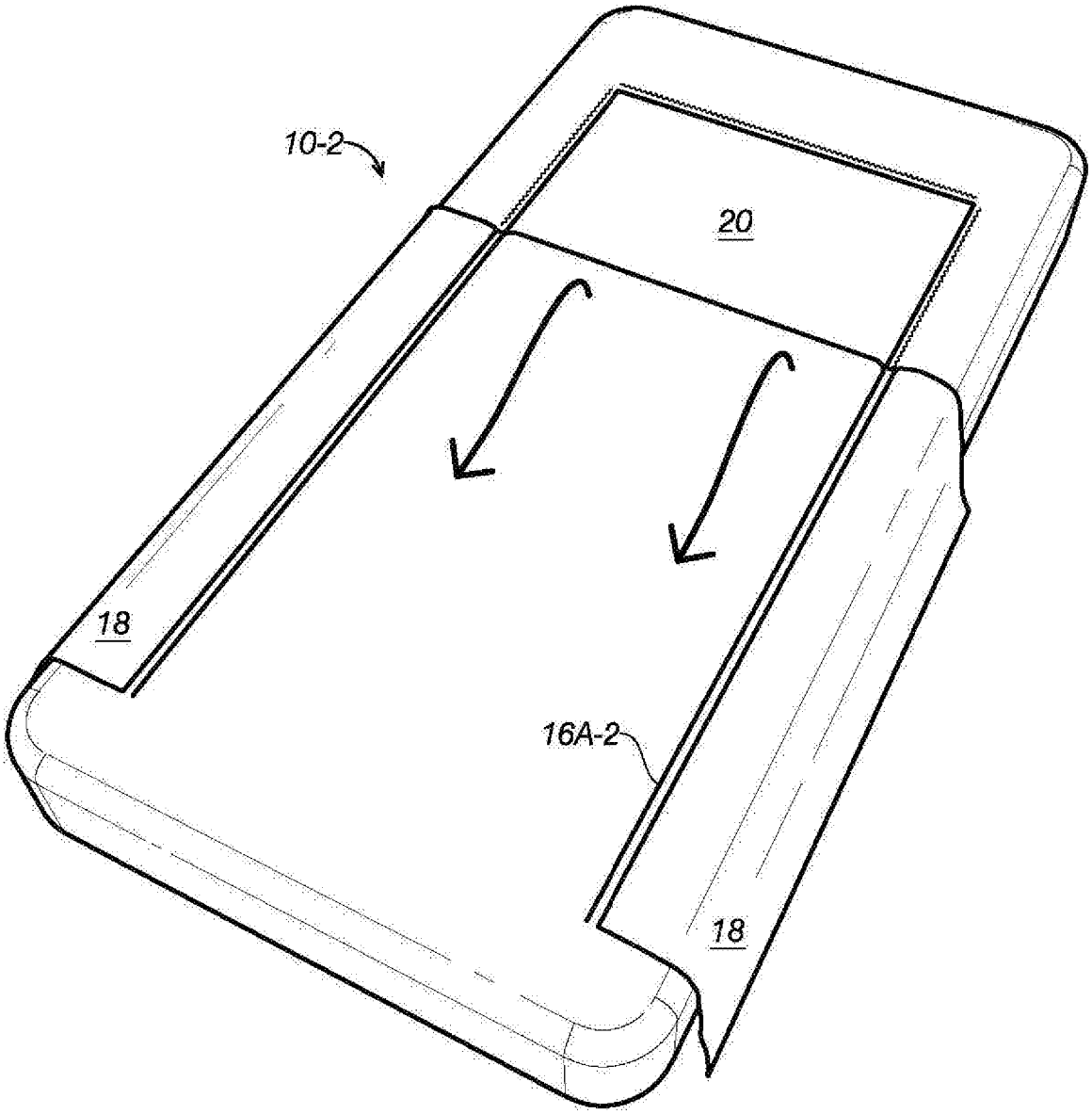
FIG. 3C is a perspective view of an article of bedding having a head opening and an exposed slit opening on each side of the article of bedding with flaps along the sides extending toward the floor, according to another exemplary embodiment of the present invention, disposed on a mattress.

The side opening 16A-2 may simply be a cut in the bedding 10-2 (as shown in FIGS. 3B and 3C) or may include, as discussed above, one or more closures, such as a zipper, snaps, buttons, hook and loop fasteners or the like (as shown in FIGS. 3 and 3A).

Figure 3D:
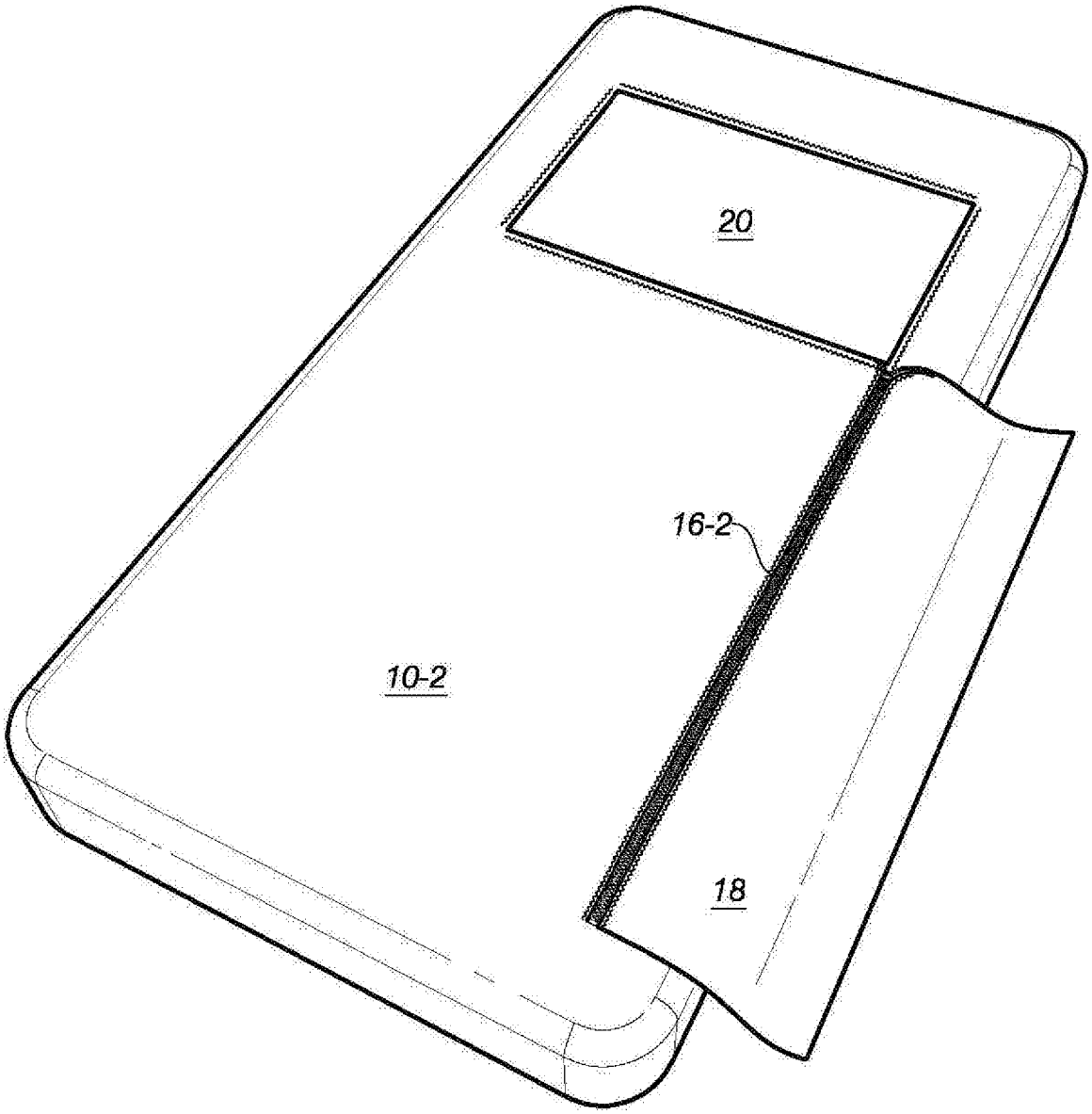
FIG. 3D is a perspective view of an article of bedding having a head opening and an exposed closure mechanism on one side of the article of bedding with a flap along the same side extending toward the floor, according to another exemplary embodiment of the present invention, disposed on a mattress.
Figure 3E:
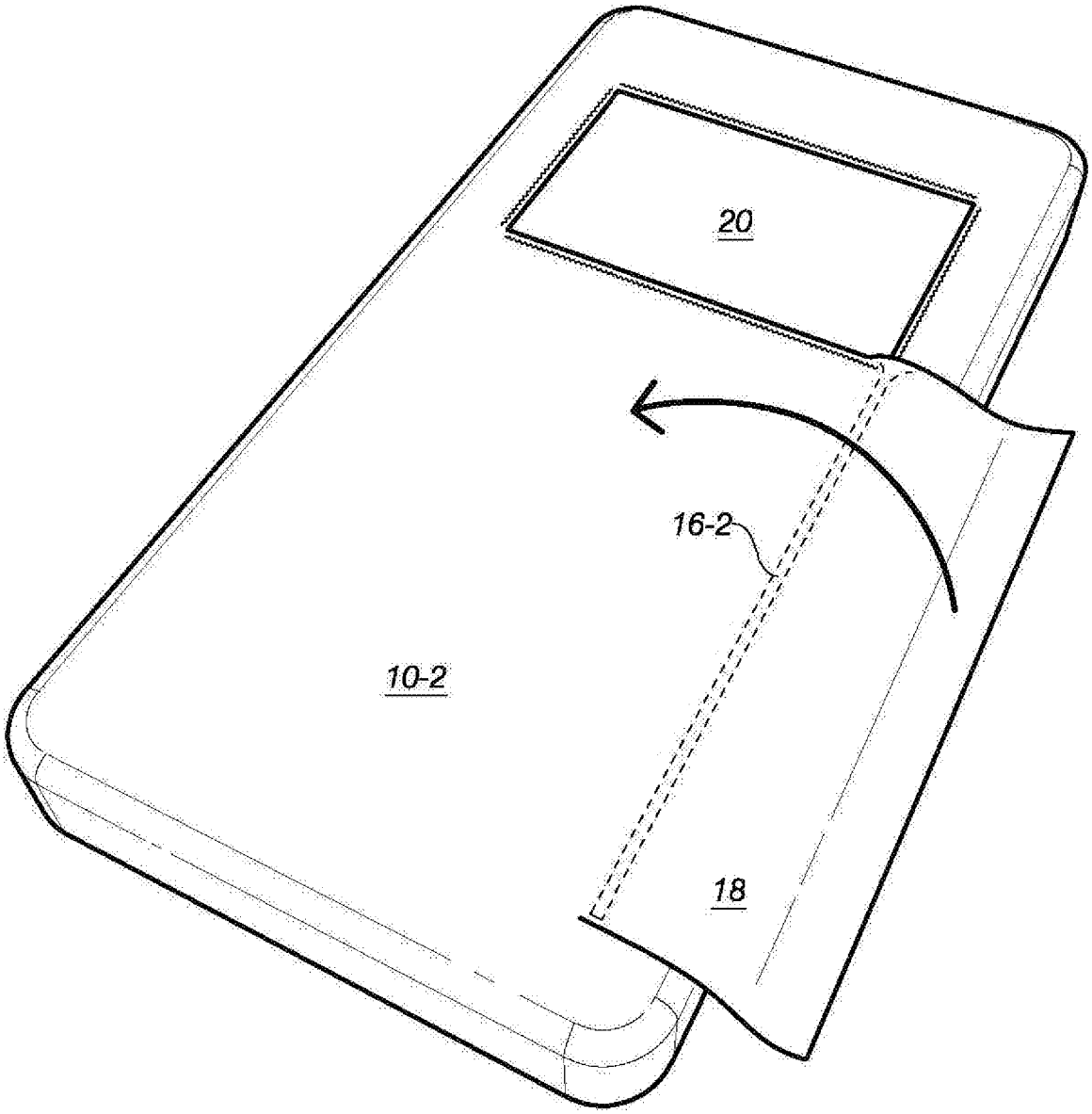
FIG. 3E is a perspective view of an article of bedding having a head opening and a covered closing mechanism on one side of the article of bedding with a flap along the same side extending toward the floor, according to another exemplary embodiment of the present invention, disposed on a mattress.

In some embodiments, as shown in FIG. 3D and FIG. 3E, a single side opening 16-2 may be disposed along a side of the bedding 10-2 and a single flap 18 can be disposed along the same side. While the Figures show the flap being the same size as the side opening 16-2, the flap may be different sizes and may extend to the foot of the bed. The side opening 16-2 may be exposed, as shown in FIG. 3D, or may be covered by the flap 18, as shown in FIG. 3E.

Figure 3F:
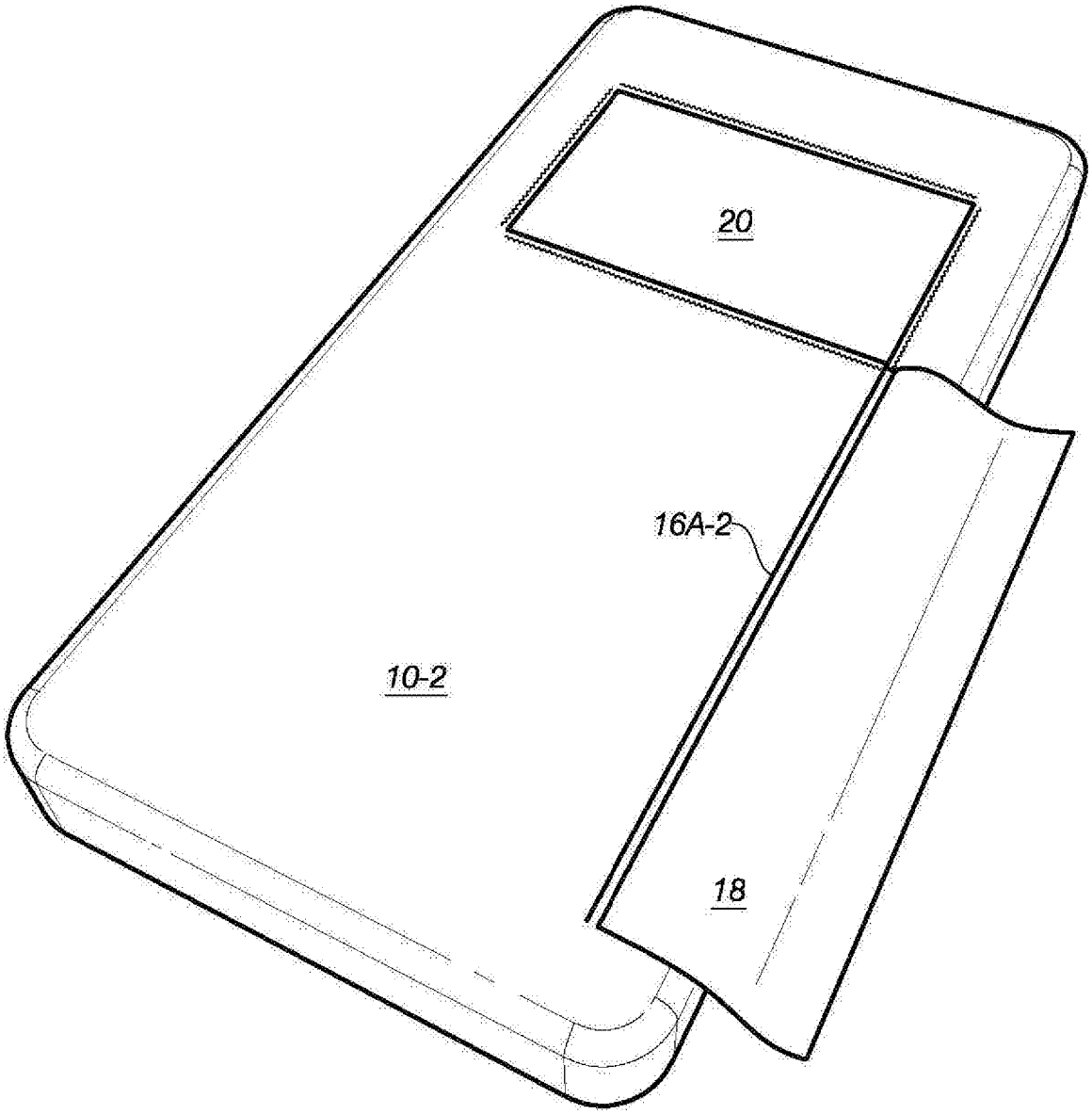
FIG. 3F is a perspective view of an article of bedding having a head opening and an exposed slit opening on one side of the article of bedding with a flap along the same side extending toward the floor, according to another exemplary embodiment of the present invention, disposed on a mattress.
Figure 3G:
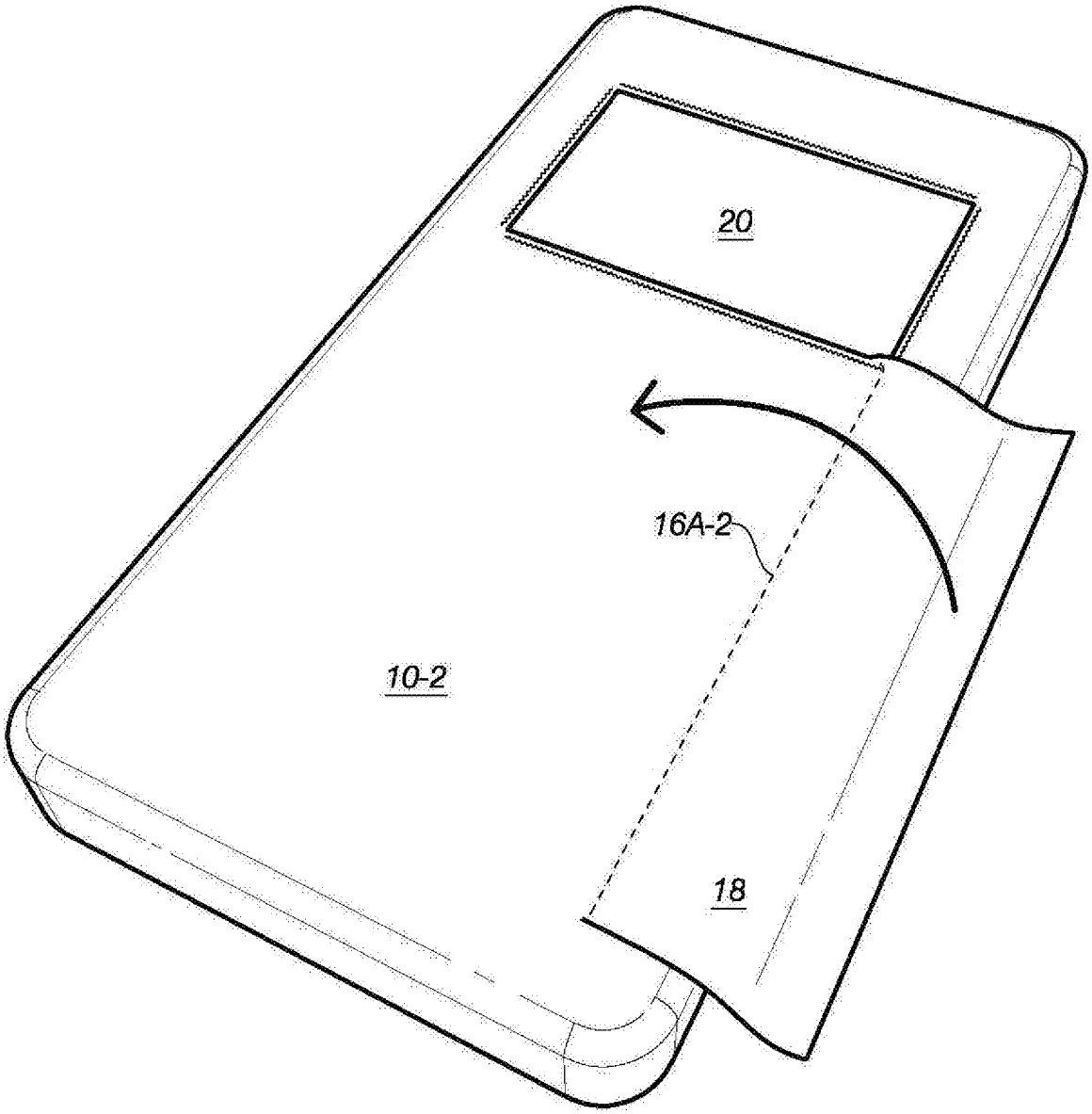
FIG. 3G is a perspective view of an article of bedding having a head opening and a covered slit opening on one side of the article of bedding with a flap along the same side extending toward the floor, according to another exemplary embodiment of the present invention, disposed on a mattress.

Referring now to FIGS. 3F and 3G, in place of the closable side openings 16-2, a slit opening 16A-2 may be disposed along one side of the bedding 10-2 and a single flap 18 can be disposed along the same side. While the Figures show the flap being the same size as the side opening 16-2, the flap may be different sizes and may extend to the foot of the bed. The slit opening 16A-2 may be exposed, as shown in FIG. 3F, or may be covered by the flaps 18, as shown in FIG. 3G.

Figure 3H:
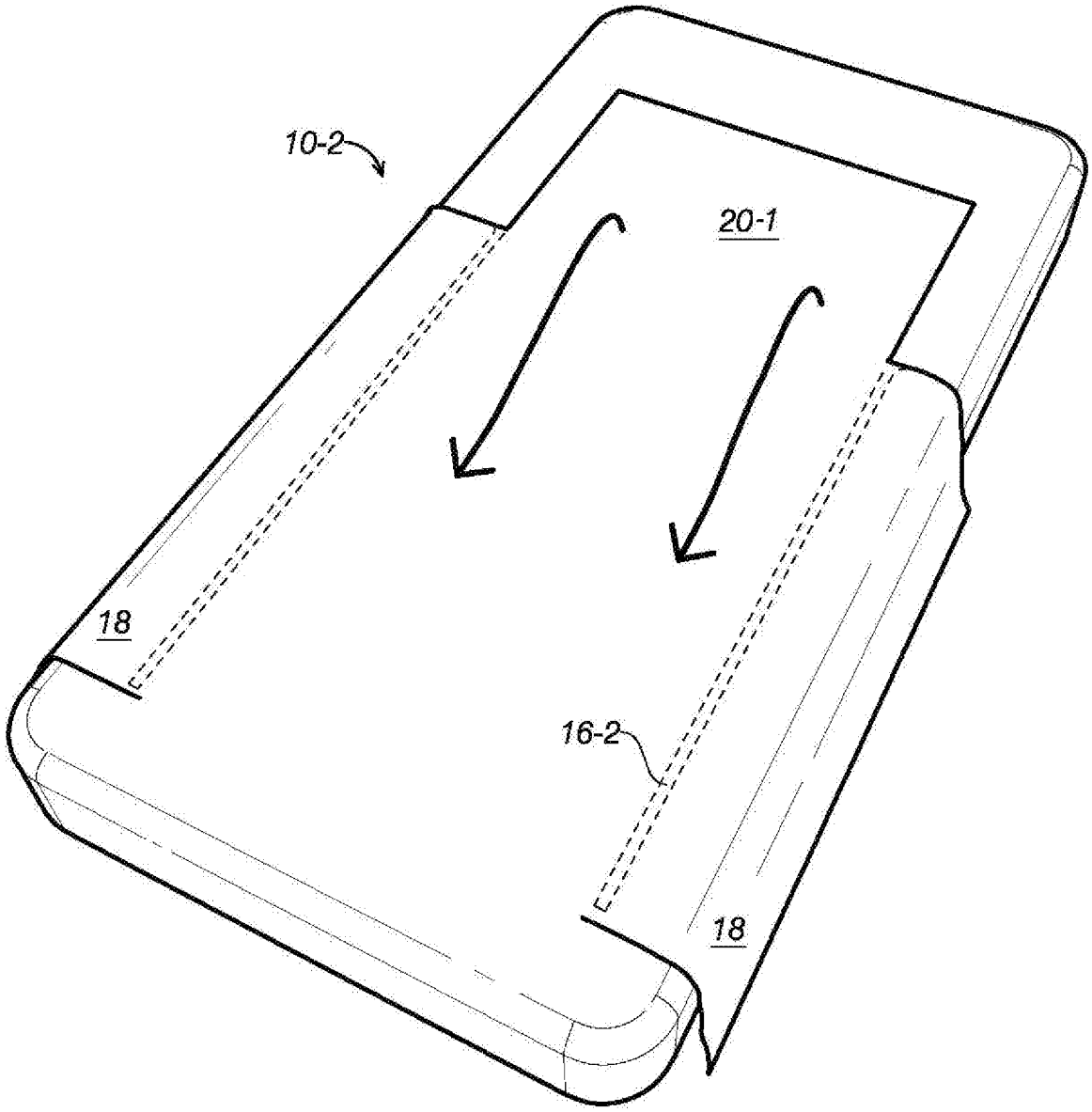
FIG. 3H is a perspective view of an article of bedding having a coverable head opening and a covered closure mechanism on each side of the article of bedding with flaps along the sides extending toward the floor, according to another exemplary embodiment of the present invention, disposed on a mattress.

Referring now to FIG. 3H, in some embodiments, the opening 20 (as shown in FIG. 3, for example) can be covered by a flap 20-1 extending from the bedding. The flap 20-1 may cover the opening 20 when the bed is made, for example, covering a pillow disposed thereunder. The flap 20-1 may be cut out from the bedding to allow access underneath. In some embodiment, the flap 20-1 can include a connection mechanism (not shown) to attach the sides and/or the top of the flap 20-1 to the bedding.

Figure 3I:
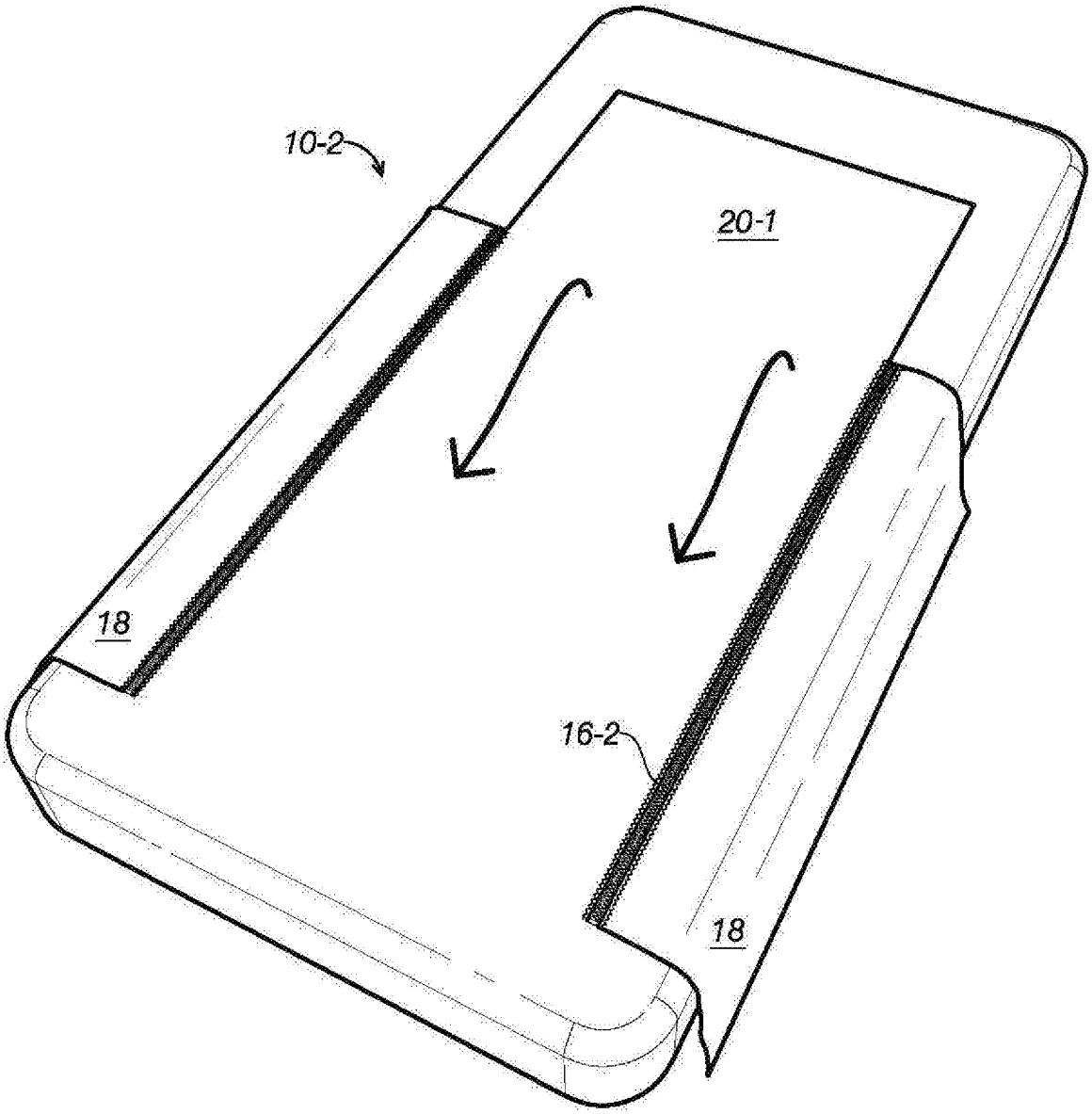
FIG. 3I is a perspective view of an article of bedding having a coverable head opening and an exposed closure mechanism on each side of the article of bedding with flaps along the sides extending toward the floor, according to another exemplary embodiment of the present invention, disposed on a mattress.
Figure 3J:
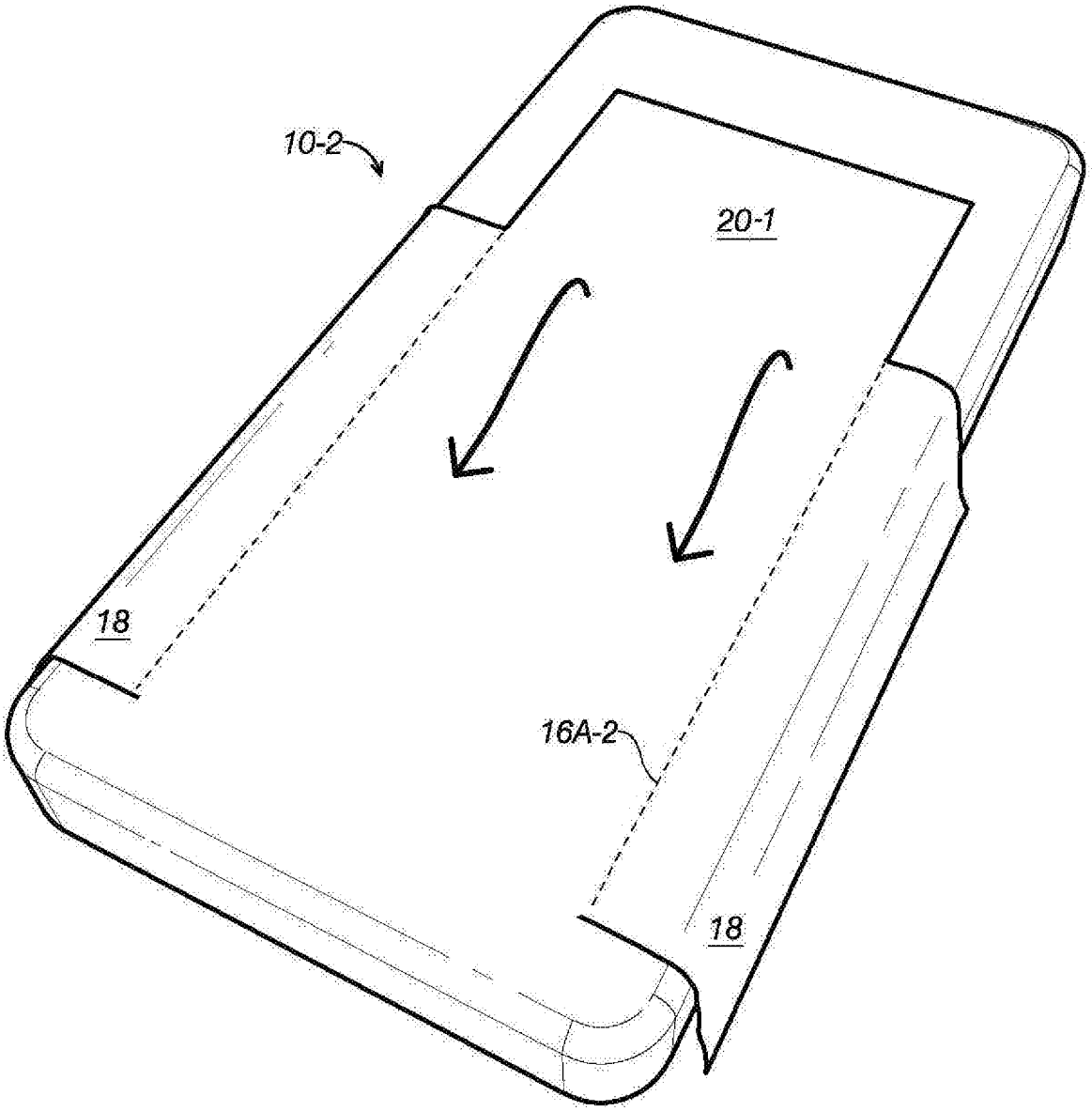
FIG. 3J is a perspective view of an article of bedding having a covered head opening and a covered slit opening on each side of the article of bedding with flaps along the sides extending toward the floor, according to another exemplary embodiment of the present invention, disposed on a mattress.
Figure 3K:
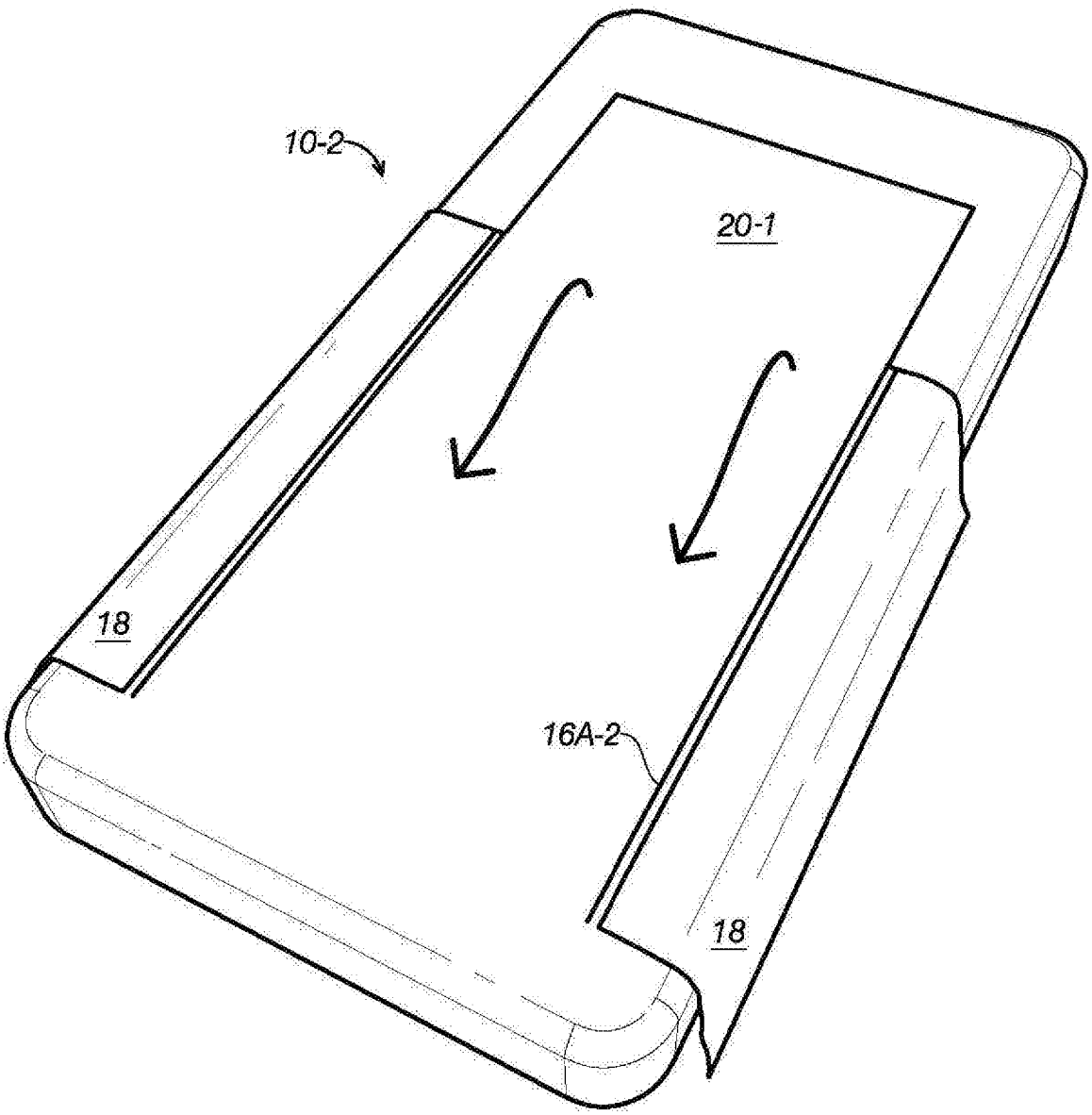
FIG. 3K is a perspective view of an article of bedding having a covered head opening and an exposed slit opening on each side of the article of bedding with flaps along the sides extending toward the floor, according to another exemplary embodiment of the present invention, disposed on a mattress.

While FIG. 3H shows a hidden closable side opening 16-2, referring to FIGS. 3I, 3J and 3K, in place of the closable side openings 16-2, a slit opening 16A-2 may be disposed along one side of the bedding 10-2 and a flap 18 can be disposed along each side thereof. While the Figures show the flap being the same size as the side opening 16-2, the flap may be different sizes and may extend to the foot of the bed. The closable side opening 16-2 may be exposed, as shown in FIG. 3I. The slit opening 16A-2 may be exposed, as shown in FIG. 3J, or may be covered by the flaps 18, as shown in FIG. 3K.

While FIGS. 3H through 3K show flaps 18 on both sides of the bedding 10-2, only a single flap may be disposed as well, similar to that shown in FIGS. 3D through 3G, with the addition of the flap 20-1 covering the opening 20.

The flap 20-1 of FIGS. 3H through 3K may extend beyond the sides and/or top of the opening 20. In some embodiments, the flap 20-1 may extend along the sides and/or head end of the bedding 10-2.

Figure 4:
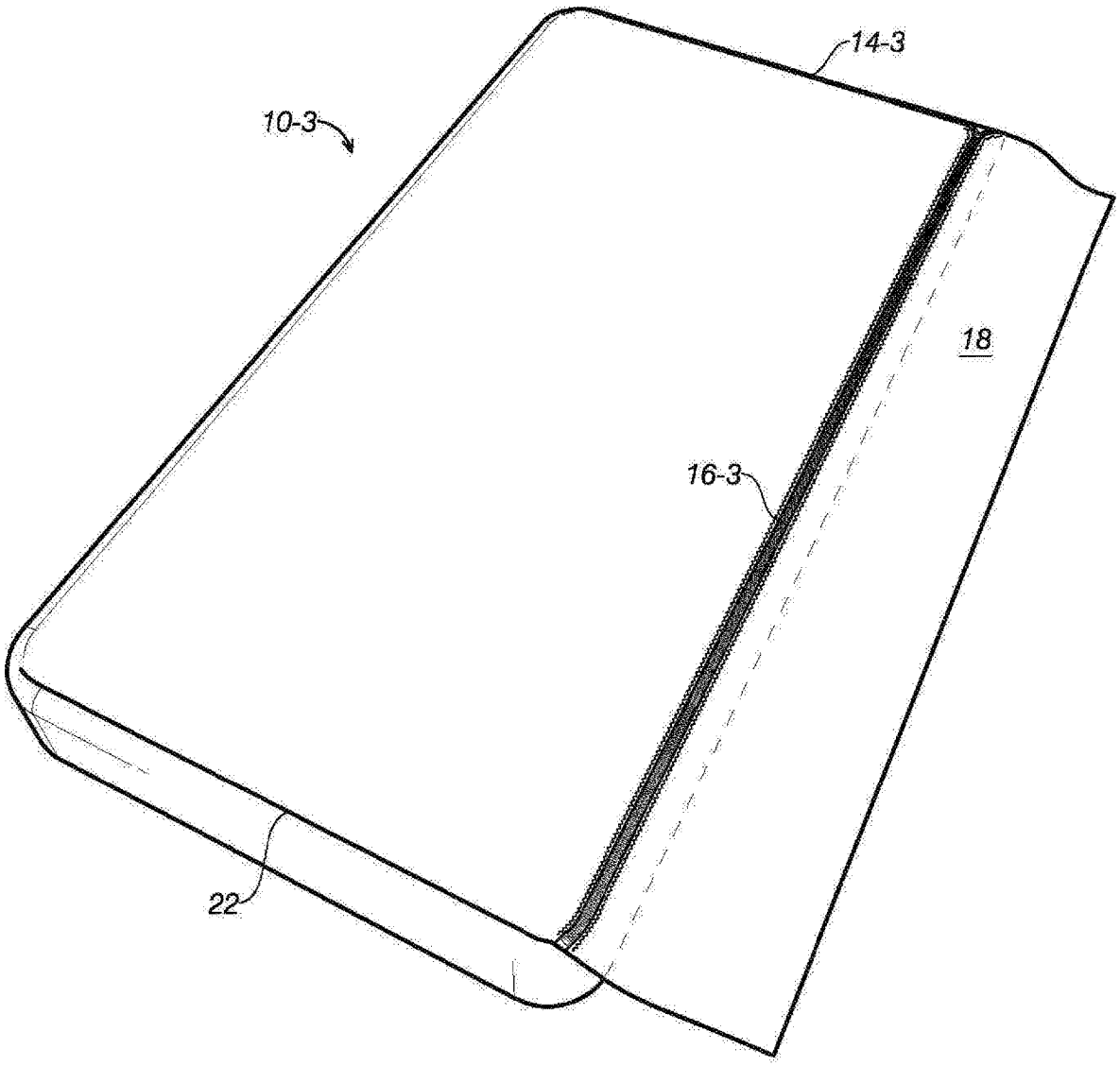
FIG. 4 is a perspective view of an article of bedding having an exposed closure mechanism running along an entire side thereof with a flap along the same side extending toward the floor, according to another exemplary embodiment of the present invention, disposed on a mattress.

Referring to FIG. 4, in some embodiments, bedding 10-3 can include not only a head end opening 14-3 and a side opening 16-3, but may also include a foot end opening 22. The head end opening 14-3 may be a slit, as discussed above with respect to FIGS. 1, 2 and 2A, for example, or an opening 20, as discussed above with respect to FIGS. 3 and 3A, for example. The side opening 16-3 can extend from the head end opening 14-3 to the foot end opening 22. The foot end opening 22 may extend across the entire width of the bedding 10-3 (when installed on the mattress). In this embodiment, the bedding 10-3 can be opened and moved completely to one side of the mattress. Alternatively, the foot end opening may extend only a portion of the width of the bedding 10-3 along the foot end thereof. In some embodiments, the bedding 10-3 can include one or more flaps 18. Like those flaps discussed above, the flaps 18 may be disposed on one or both sides of the bedding, as well as along the foot end and/or the head end of the bedding.

In some embodiments, the side opening 16-3 may include a closure to close the opening, as shown in FIG. 4. Similarly, the foot end opening 22 may also include a closure to close the opening.

Figure 4A:
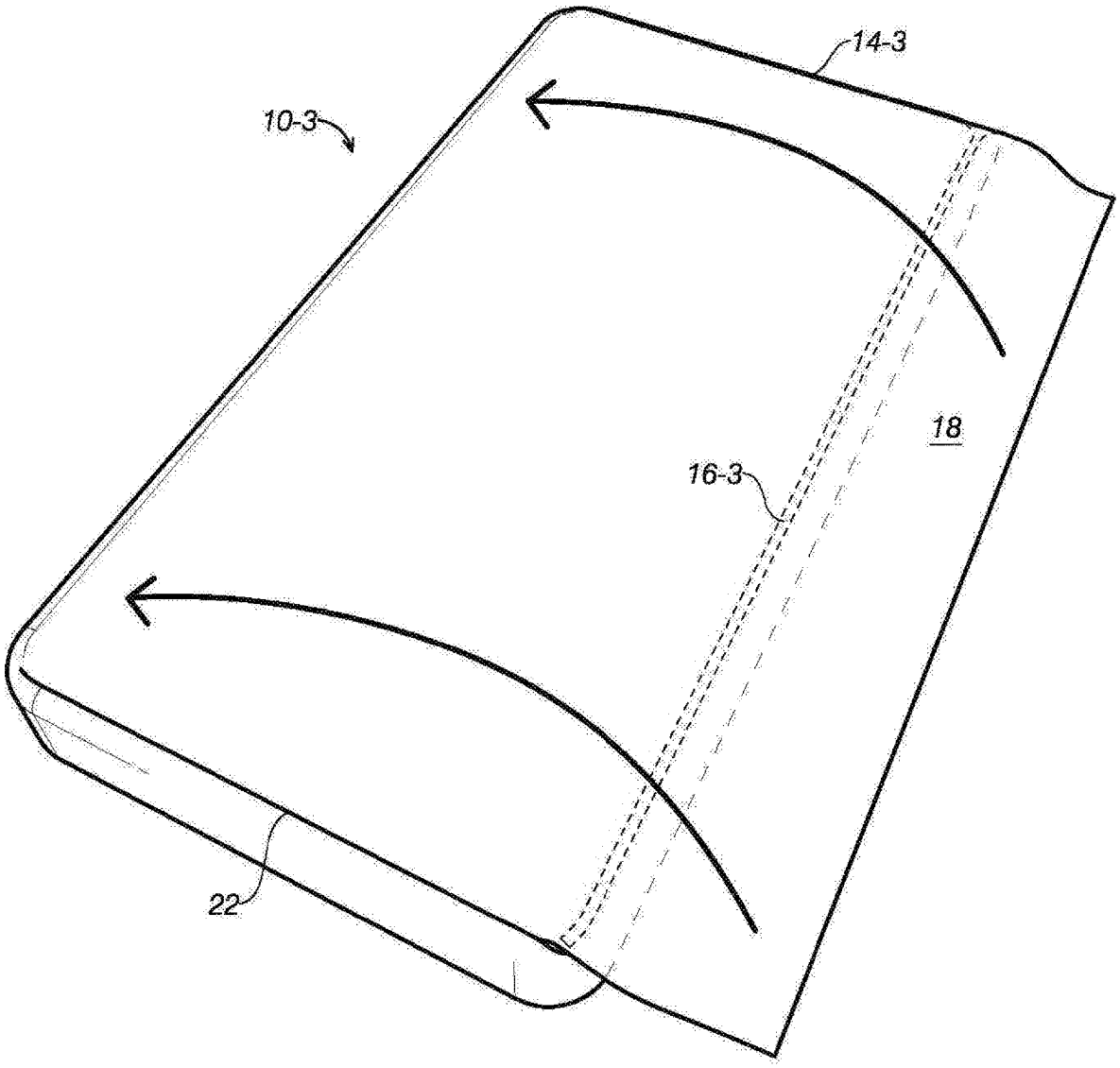
FIG. 4A is a perspective view of an article of bedding having a covered closure mechanism running along an entire side thereof with a flap along the same side extending toward the floor, according to another exemplary embodiment of the present invention, disposed on a mattress.
Figure 4B:
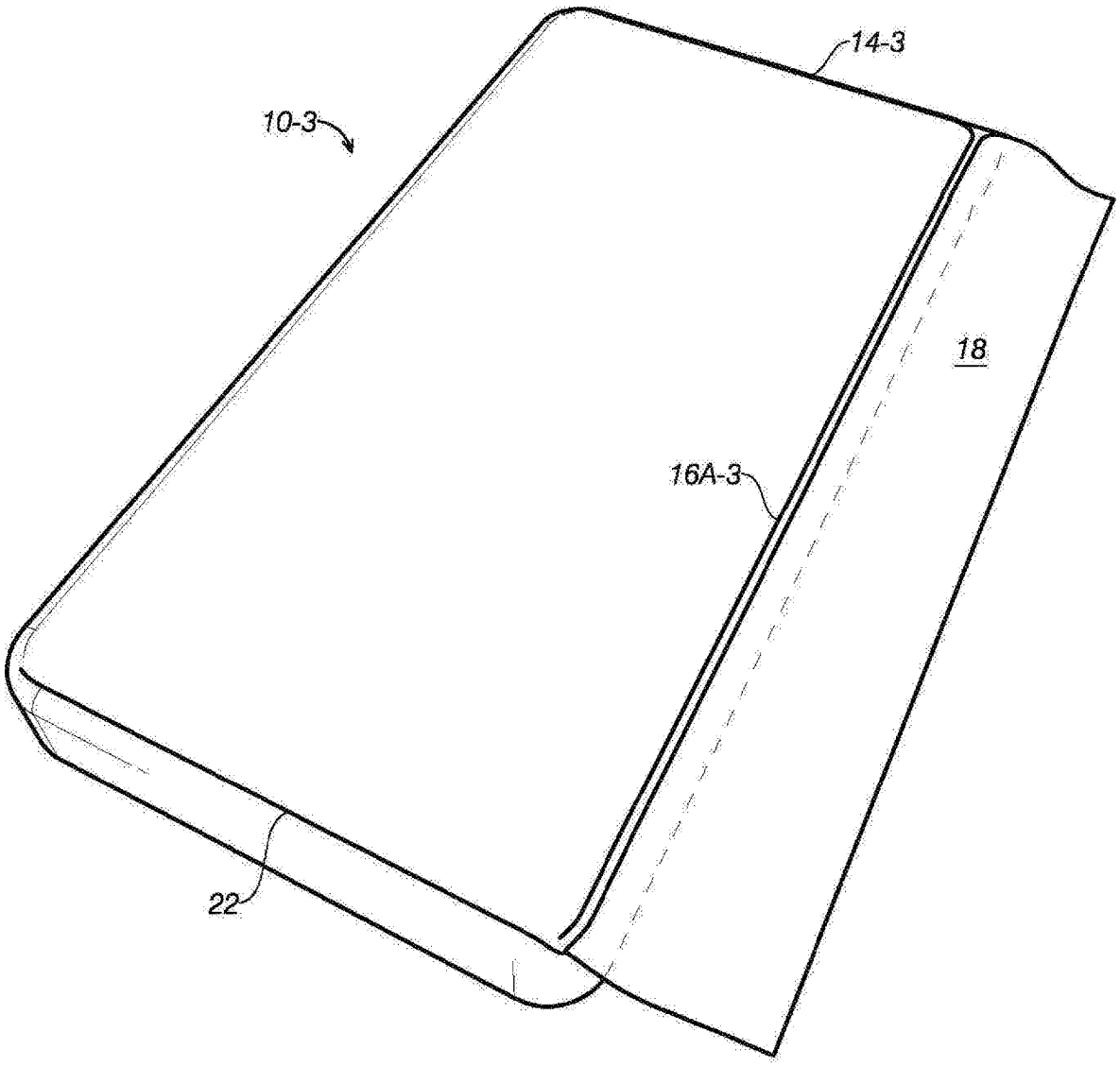
FIG. 4B is a perspective view of an article of bedding having an exposed slit opening running along an entire side thereof with a flap along the same side extending toward the floor, according to another exemplary embodiment of the present invention, disposed on a mattress.
Figure 4C:
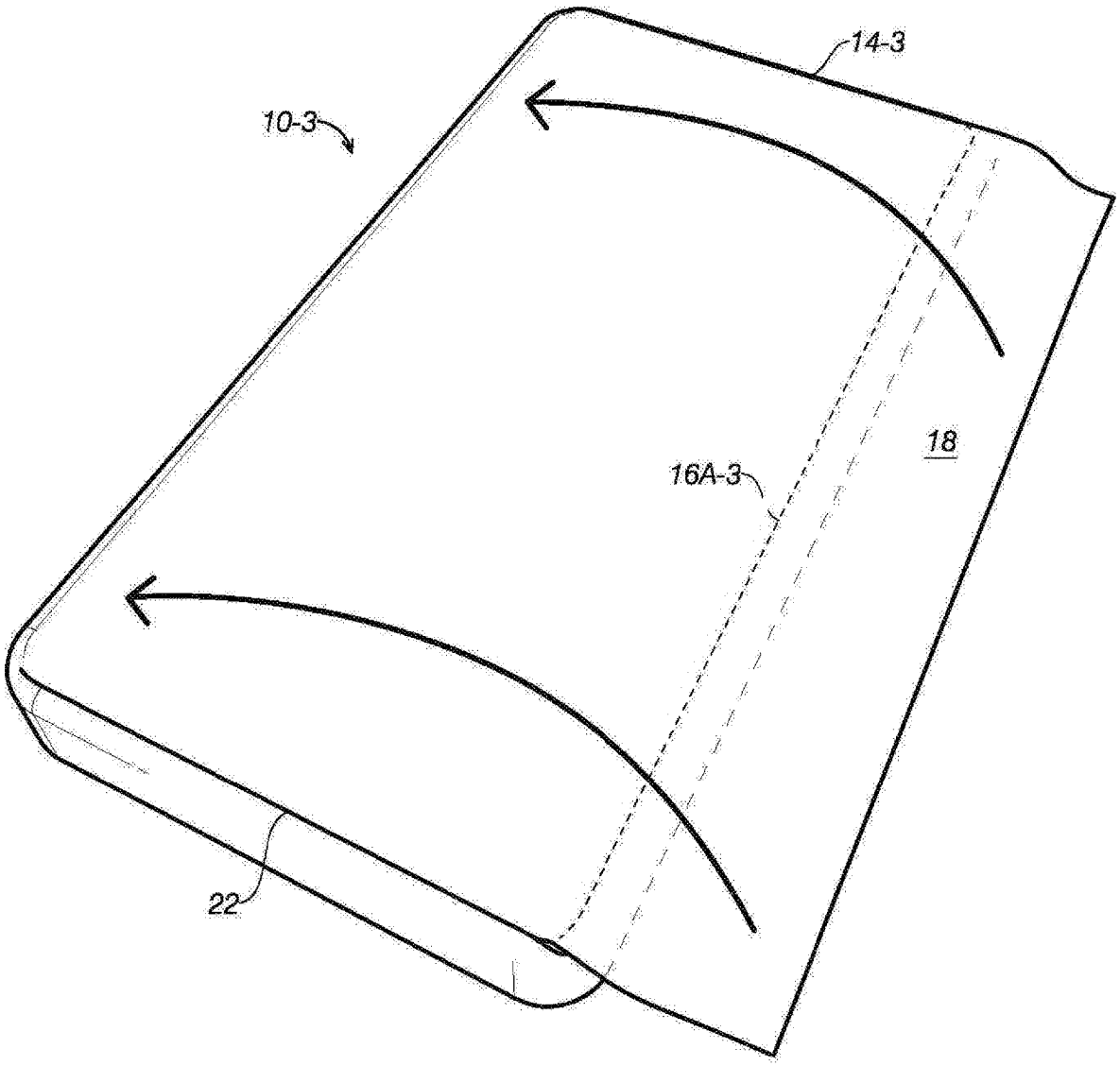
FIG. 4C is a perspective view of an article of bedding having a covered slit opening running along an entire side thereof with a flap along the same side extending toward the floor, according to another exemplary embodiment of the present invention, disposed on a mattress.

In some embodiments, the flap 18 may leave the side opening 16-3 exposed, as shown in FIG. 4, or may cover the side opening 16-3, as shown in FIG. 4A. Similar to the above embodiments, the side opening 16-3 could be a slit opening 16A-3, where the slit opening 16A-3 may be exposed (as shown in FIG. 4B) or may be covered by the flap 18 (as shown in FIG. 4C).

As discussed above, in each of the embodiments, the side openings 16, 16-1, 16-2 and 16-3 may be covered by the bedding and the flaps 18 so that they are not visible when the bedding 10 is made on the mattress. In other embodiments, the side openings 16, 16-1, 16-2 and 16-3 can be visible from the top of the bedding 10.

Referring now to FIGS. 5 through 9, a fitted blanket 100 can be disposed over a mattress 240. The fitted blanket 100 may be similar to a conventional fitted sheet, including elastic 120 disposed about at least a portion of the underside edges of the fitted blanket 100, allowing the sides of the fitted blanket 100 to be resiliently disposed under the mattress 240.

On the top side of the mattress 240, the fitted blanket 100 may include a cut-out 220 for pillow placement. The cut-out 220 may be stitched or lined with piping, such as flat piping. The cut-out 220 may be removably covered with a portion of the fitted blanket 100 attached to at least one side of the cut-out 220.

Figure 5:
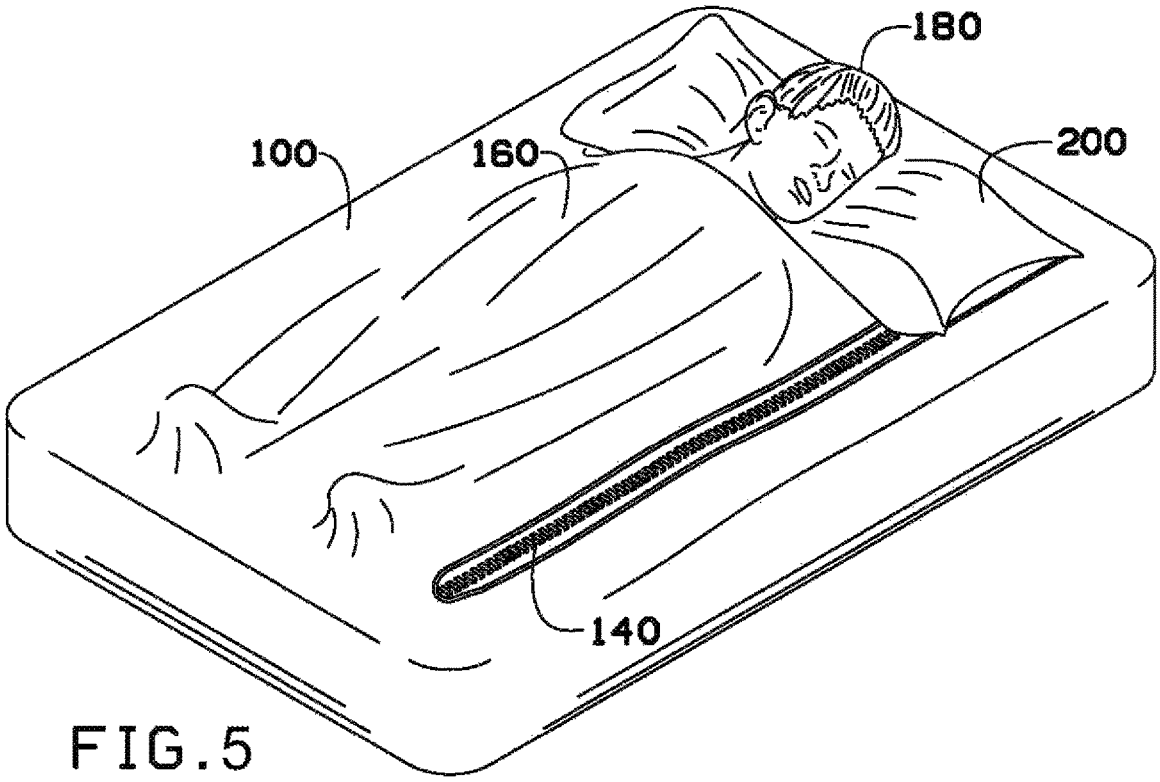
FIG. 5 is a perspective view of a fitted blanket, in use, according to another exemplary embodiment of the present invention.
Figure 6:
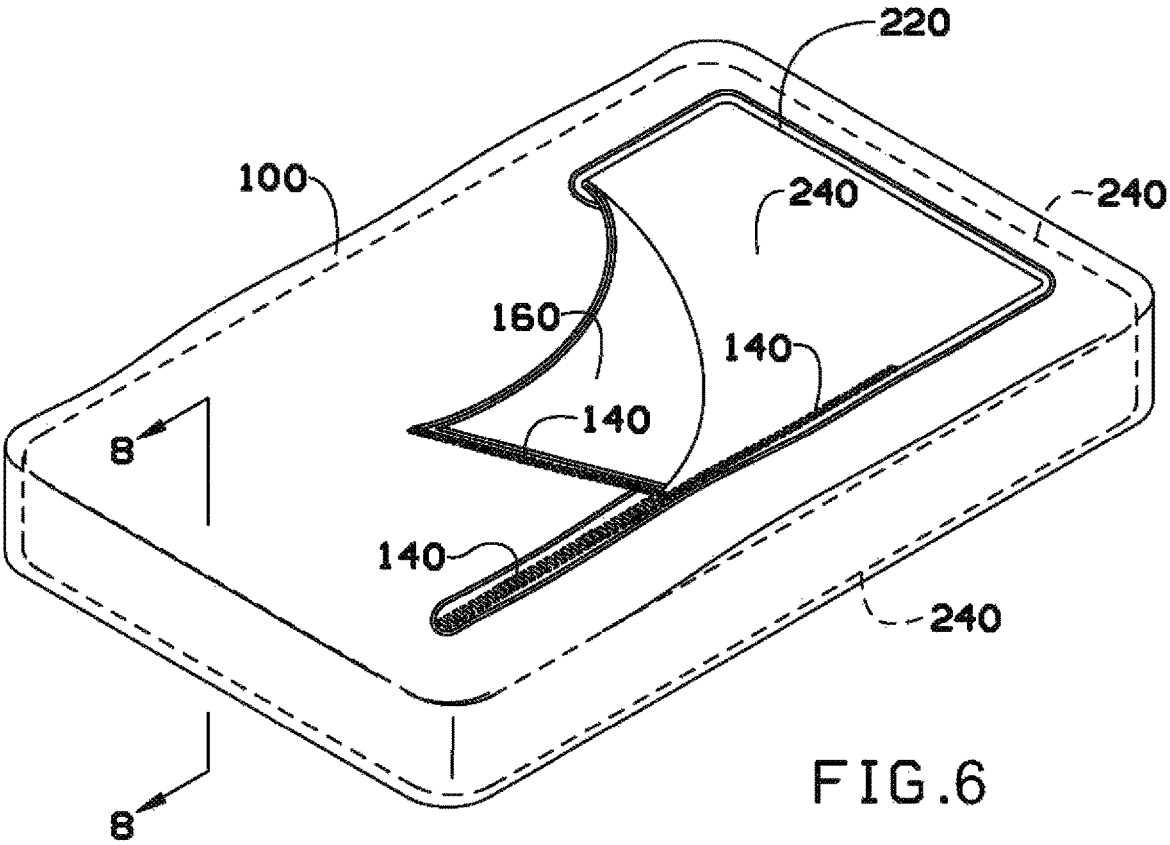
FIG. 6 is a perspective view of the fitted blanket of FIG. 5 illustrated installed and shown with its flap in a partial open configuration.
Figure 7:
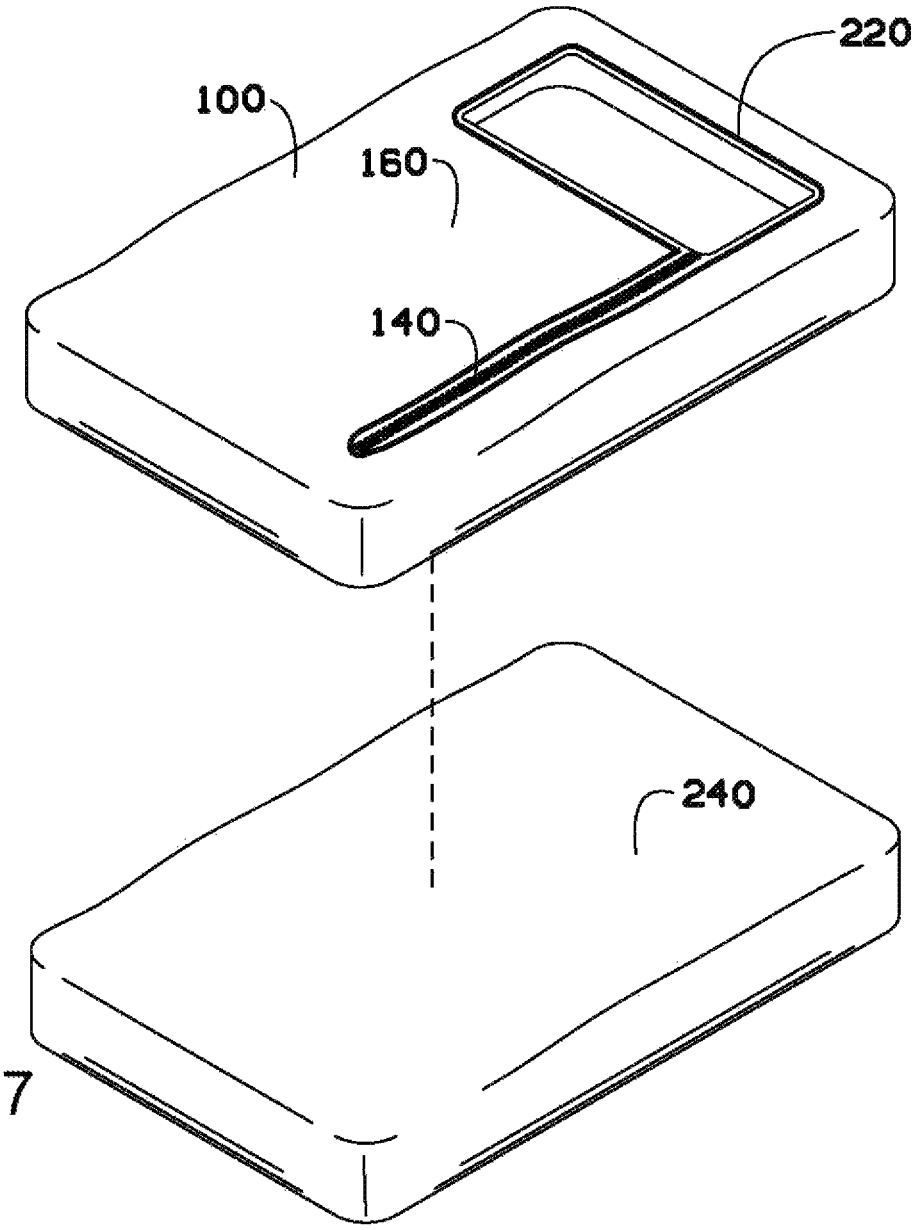
FIG. 7 is an exploded perspective view of the fitted blanket of FIG. 5 separated from the mattress.
Figure 8:
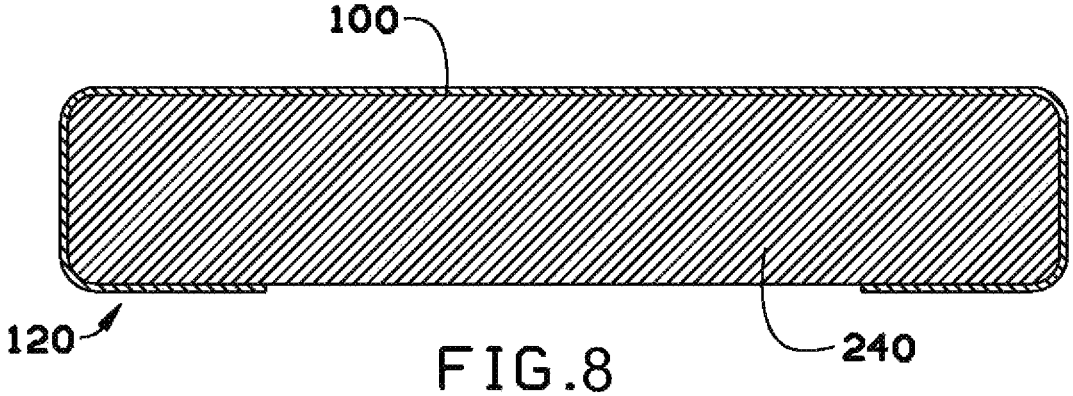
FIG. 8 is a cross-sectional view taken along line 8-8 of FIG. 6.
Figure 9:
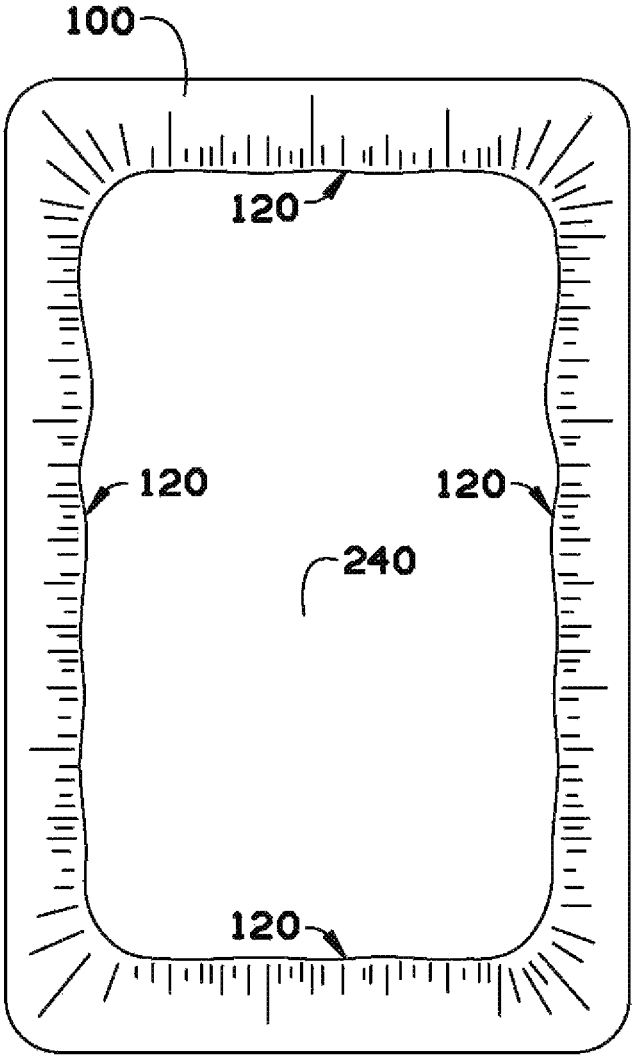
FIG. 9 is a bottom view of the fitted blanket of FIG. 1.

The fitted blanket 100 may include blanket connection 140 along one side of the fitted blanket 100, starting at the pillow cut-out 220 and running substantially parallel with the length of the mattress 240. When the blanket connection 140 is disconnected (as shown partially disconnected, or partially unzipped, as shown in FIG. 6), a flap 160 can be formed that can be folded down to allow a user 180 to get under the flap 160. When the blanket connection 140 is closed, the user can be disposed under the flap 160 and cannot roll out or kick off the blanket, as shown in FIG. 5.

In some embodiments, the blanket connection 140 may run toward the foot end of the bedding material, without reaching the end thereof. For example, the blanket connection 140 may run from about 50 to about 90 percent of the length of the fitted blanket 100 from the pillow cut-out 220. In some embodiments, the blanket connection 140 may run from the pillow cut-out 220 until reaching a point that is about 7 to 20 inches, typically about 9 inches, from the edge of the mattress 240 (when the fitted blanket 100 is fitted on the mattress 240). In some embodiments, the blanket connection 140 may not be connected with the pillow cut-out 220, but instead, may simply form an opening in the fitted blanket 100. The blanket connection 140 is typically a zippered opening. The zippered opening may allow easy entry and exit from the blanket, and also provide a quick way of making the bed. In some embodiments, other blanket connections may be used, such as snaps, buttons, hook and loop fasteners, or the like. In other embodiments, the blanket connection, as described above, may simply be an opening formed in the bedding, without any connectors to connect the opening together.

In each of the embodiments, the head end opening 14, 14-2, 14-3 may be disposed as a slit not only along the top but also along a portion of the sides of the bedding, allowing a flap of the head end of the bedding to be folded down from the head end. This design may be useful to allow a portion of the bedding to be folded down away from a user's head when the user is under the bedding.

The bedding 10 can include a permanently attached or removably attached pillow. The pillow can be permanently attached by, for example, stitching, or may be removably attached by snaps, buttons, hook and loop fasteners, a zipper or the like. The pillow can be formed as a region for a user to place their head when disposed under the bedding 10.

The bedding 10 can include one or more pockets formed along a portion thereof such that when the bedding 10 is disposed on the mattress, the user may access the pockets.

For example, the pockets may lie along the side of the mattress when the bedding 10 is disposed on the mattress.

The bedding 10 can be designed in a one-piece design, configured to be placed on the mattress. While the description refers to the bedding 10 being disposed on the mattress, it should be understood that other typical articles of bedding, such as a standard fitted sheet, may be disposed on the mattress first, prior to placement of the bedding 10 over the mattress.

Typically, the side opening 16 is disposed near one side of the bedding 10, as shown in the Figures, but may also be disposed in a central region thereof. For larger blankets, for example, for king or queen sized beds, the side opening 16 may be disposed on each side and/or in the middle of the bedding 10, allowing two people to use the bedding 10 and still allow for easy entry and exit. In some embodiments, the side opening 16 (or multiple side openings) may run at an angle, for example, diagonally, down the bedding 10 from the head end opening 14.

Figure 10A:
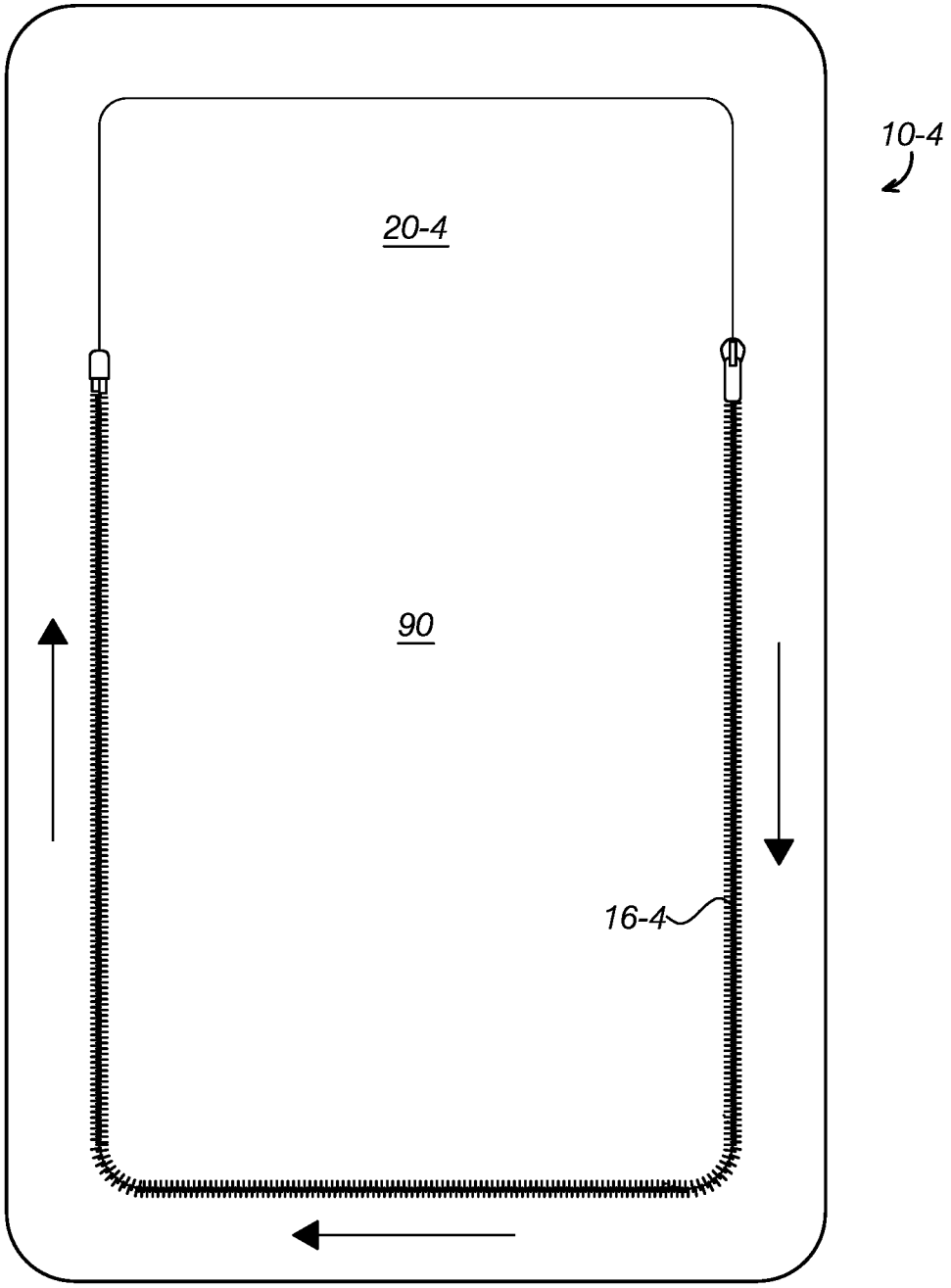
FIG. 10A is a top view of a fitted blanket having a removable center portion with a single zipper according to an exemplary embodiment of the present invention.

Referring to FIG. 10A, the side opening 16-4 may be formed around at least a portion of the bedding 10-4. In this embodiment, an opening 20-4 may be formed from a flap of material that is not connected by the side opening 16-4. While a zipper is shown as making the connection, other connectors, as described above, may be substituted for the zipper. The zipper may start and terminate at any location about the periphery of the bedding 10-4. In this embodiment, the zipper starts and ends to form the opening 20-4 as a flap at the top of the center portion 90 of the bedding 10-4.

The side opening 16-4 may communicate with the opening 20-4 so that the center portion 90 of the blanket may be removed completely from the bedding 10-4. This would allow the center portion 90 to be washed separately and also would allow different designs to be interchanged without the need to purchase and replace all of the bedding 10-4. While the term "center" portion is used to refer to center portion 90, the invention is not limited to a removable portion being centrally positioned on the mattress. In some embodiments, the center portion 90 may be positioned off-center, for example.

Figure 10B:
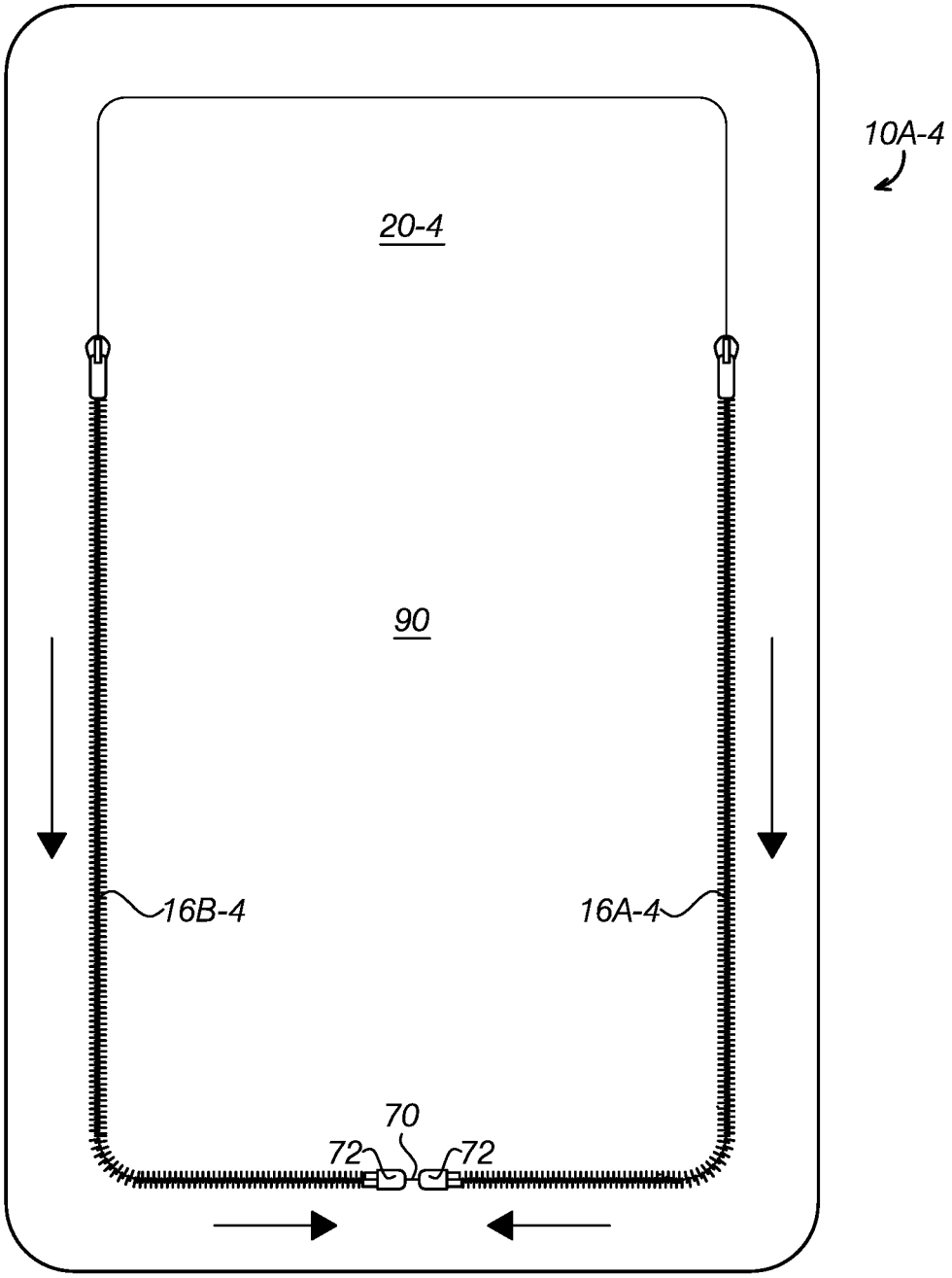
FIG. 10B is a top view of a fitted blanket having a removable center portion with a double zipper according to an exemplary embodiment of the present invention.

In an alternate embodiment, as shown in FIG. 10B, two connectors, such as two zippers, may be used to form two side openings 16A-4 and 16B-4. Each zipper can have a zip-up start connector 72 where the center portion 90 may be attached to be zipped into the bedding 10-4. In FIG. 10B, the start connectors 72 are shown at the foot of the bed, however, the start connectors 72 may be located at any location along the bedding 10-4. A cut space 70 may be disposed between opposing start connectors 72 so that, when unzipped (in the direction shown by arrows), the center portion 90 may be detached from the bedding 10-4. Like the embodiment of FIG. 10A, the opening 20-4 may be formed as a flap that may be lifted for placement of a pillow thereunder, for example.

Figure 11A:
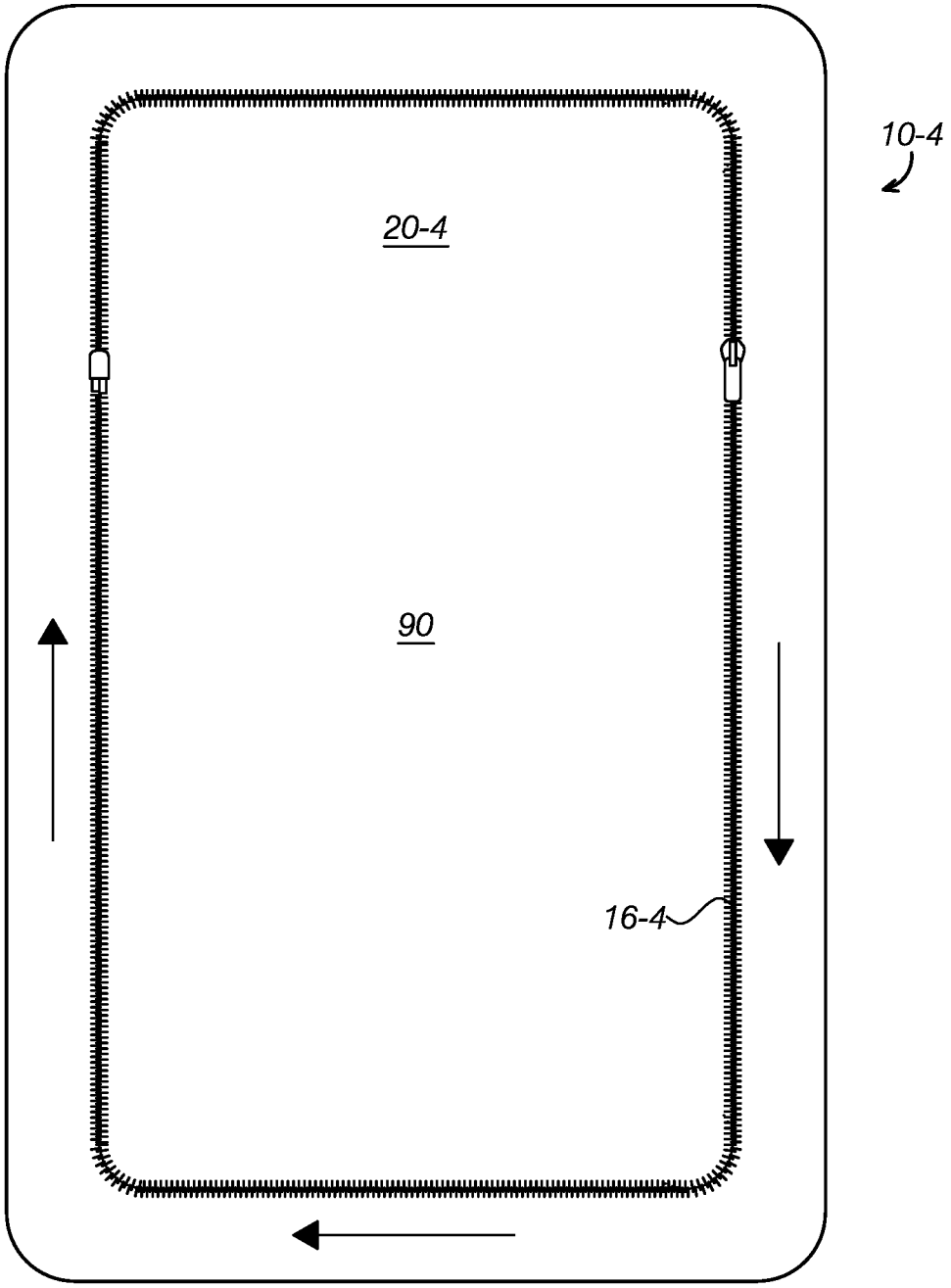
FIG. 11A is a top view of a fitted blanket having a removable center portion with a single all-around zipper according to an exemplary embodiment of the present invention.
Figure 11B:
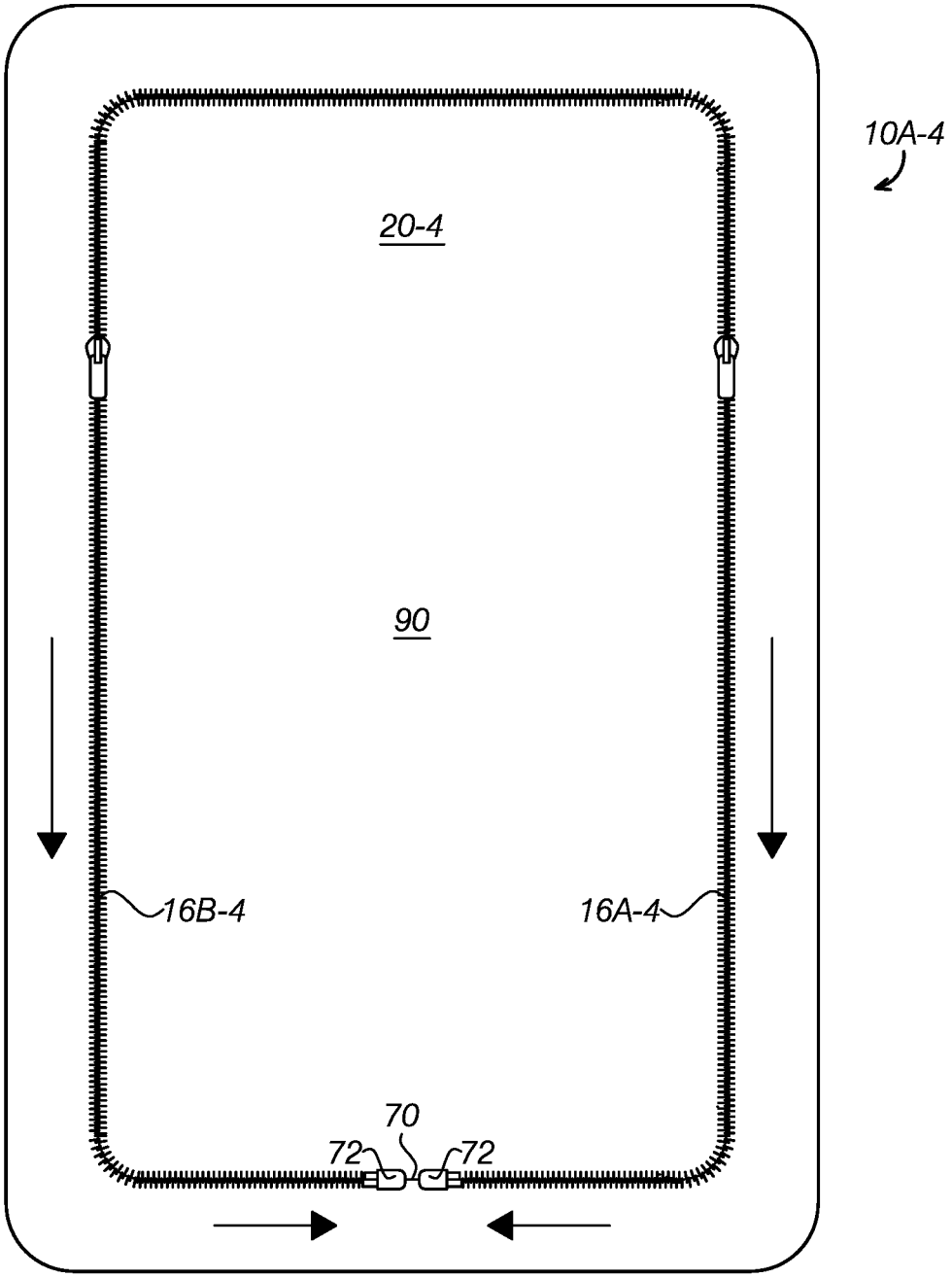
FIG. 11B is a top view of a fitted blanket having a removable center portion with a double all-around zipper according to an exemplary embodiment of the present invention.

Referring to FIGS. 11A and 11B, a single zipper design (FIG. 11A) and a dual zipper design (FIG. 11B) are shown. In these embodiments, the zipper (side opening 16-4 in FIG. 11A or side openings 16A-4 and 16B-4 in FIG. 11B) is formed entirely around the center portion 90 of the bedding 10-4. The zipper, like the above embodiments, permits removal of the center portion 90 from the bedding 10-4. However, the top opening 20-4 may be present or may be entirely closed off. In FIGS. 11A and 11B, the side openings 16-4 are closed only a portion (unzipped across the upper portion thereof), where the opening 20-4 may be a flap, like FIGS. 10A and 10B. However, in the embodiments of 11A and 11B, one may continue to zip the side openings 16-4 to completely attach the center portion 90 to the bedding 10-4.

As described in the above embodiments, the zipper may start and end in various locations and may not be limited to the specific locations shown in the Figures.

Figure 12A:
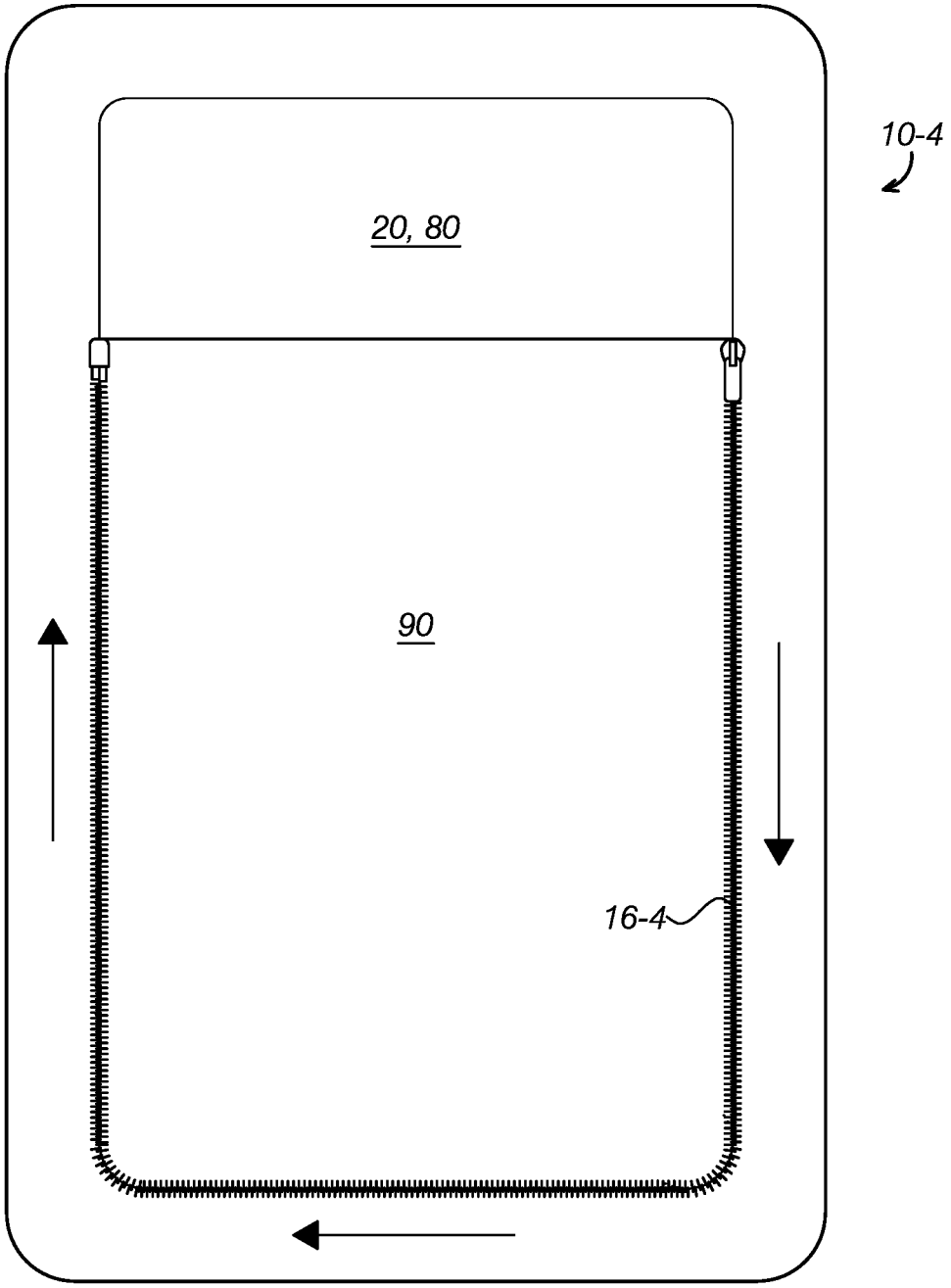
FIG. 12A is a top view of a fitted blanket having a removable center portion with an upper opening and a single zipper according to an exemplary embodiment of the present invention.
Figure 12B:
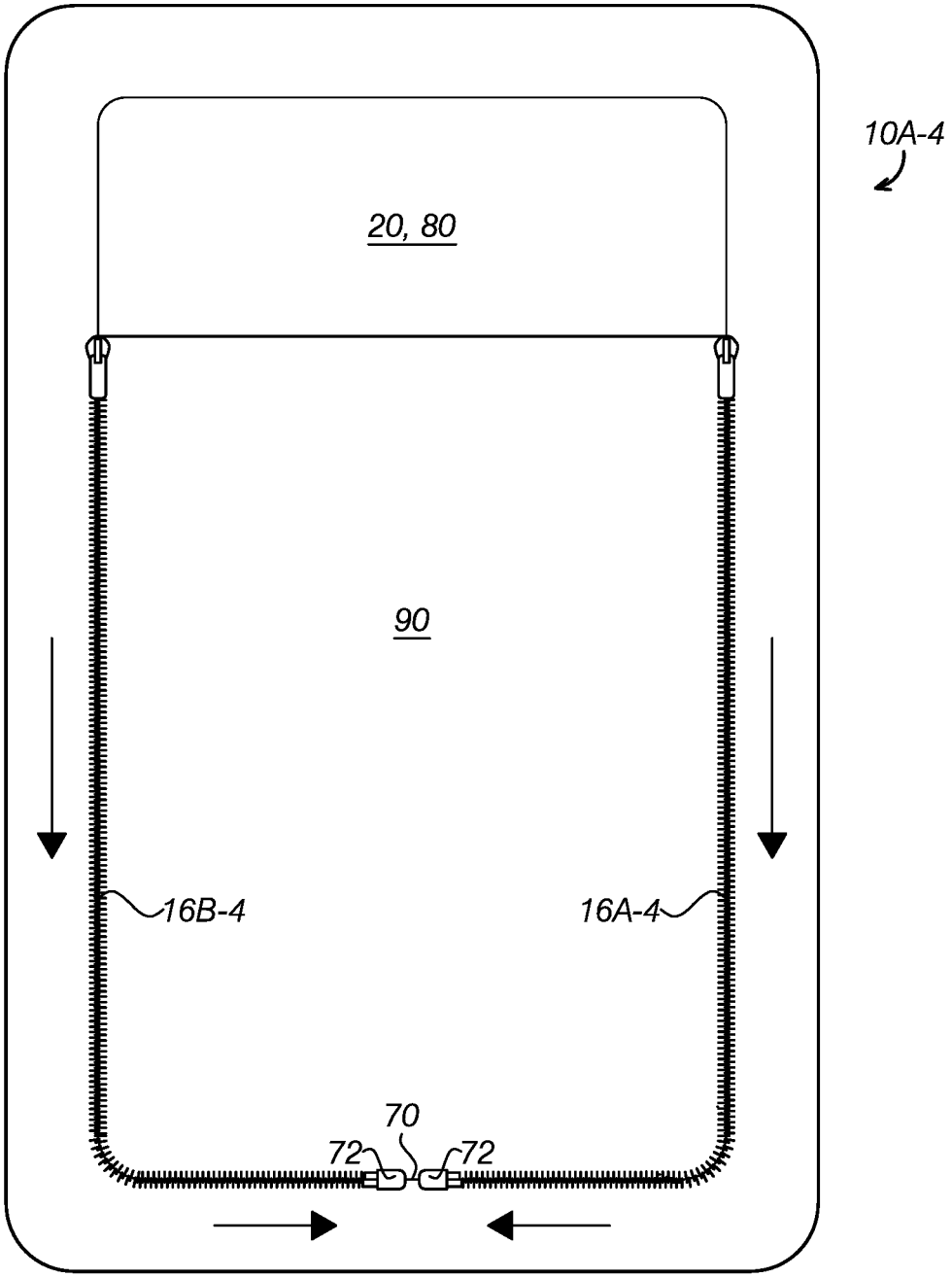
FIG. 12B is a top view of a fitted blanket having a removable center portion with an upper opening and a double zipper according to an exemplary embodiment of the present invention.

Referring to FIGS. 12A and 12B, a single zipper design (FIG. 12A) and a dual zipper design (FIG. 12B) are shown. In these embodiments, the zipper (side opening 16-4 in FIG. 12A or side openings 16A-4 and 16B-4 in FIG. 12B) is formed to extend from the opening 20 at the head end of the bedding 10-4. The opening 20 is completely open and no flaps (such as opening 20-4 that form flaps in FIGS. 10A and 10B, for example) are present to cover the opening 20. A sheet 80 may be disposed below the bedding 10-4, as described below with respect to FIGS. 14 and 15, or, the opening 20 may be open to the mattress 12. When completely unzipped, the center portion 90 may be removed from the rest of the bedding 10-4.

As described in the above embodiments, the zipper may start and end in various locations and may not be limited to the specific locations shown in the Figures.

Figure 13A:
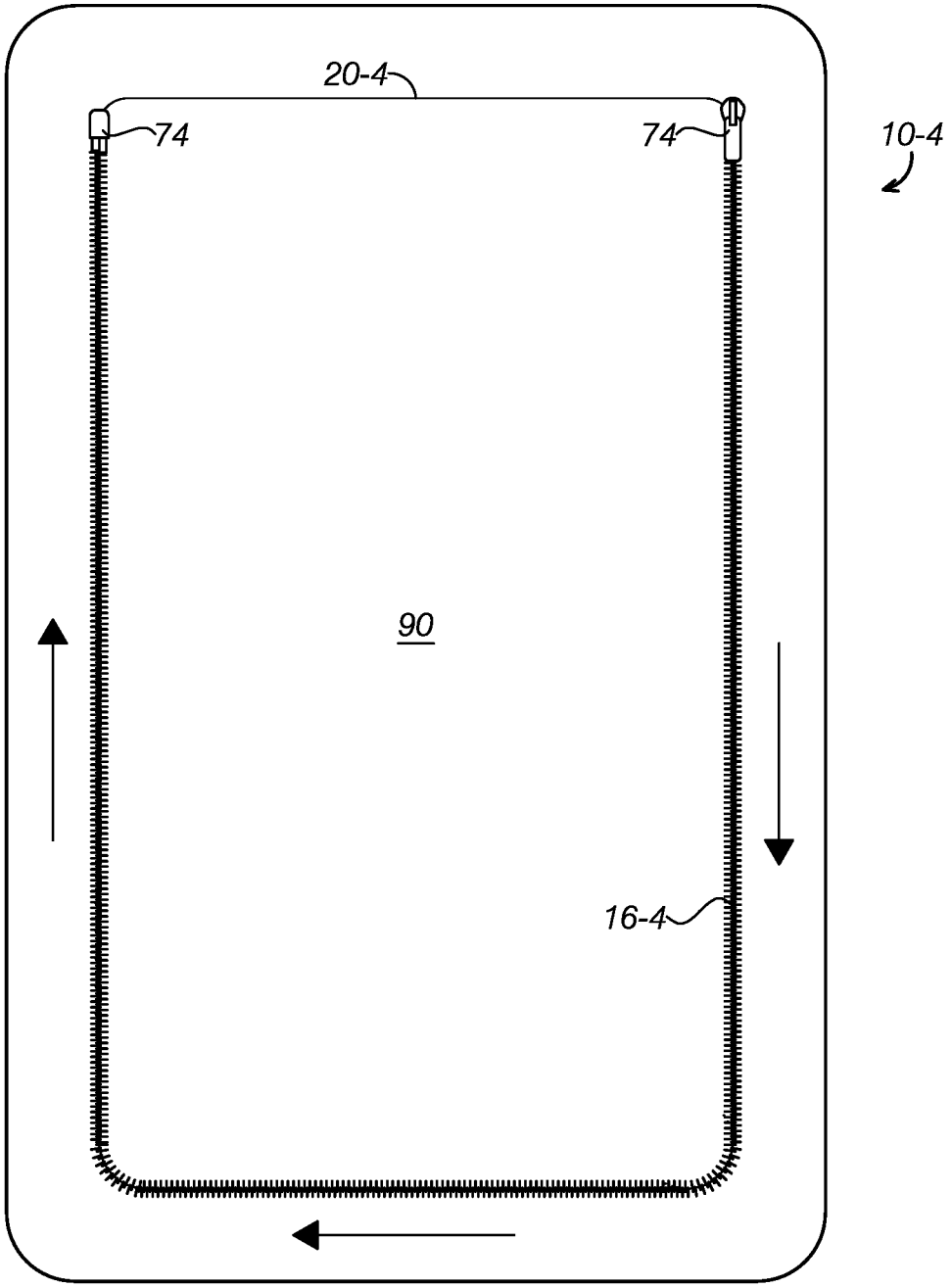
FIG. 13A is a top view of a fitted blanket having a removable center portion with a single zipper extending to an upper end of each side thereof, according to an exemplary embodiment of the present invention.
Figure 13B:
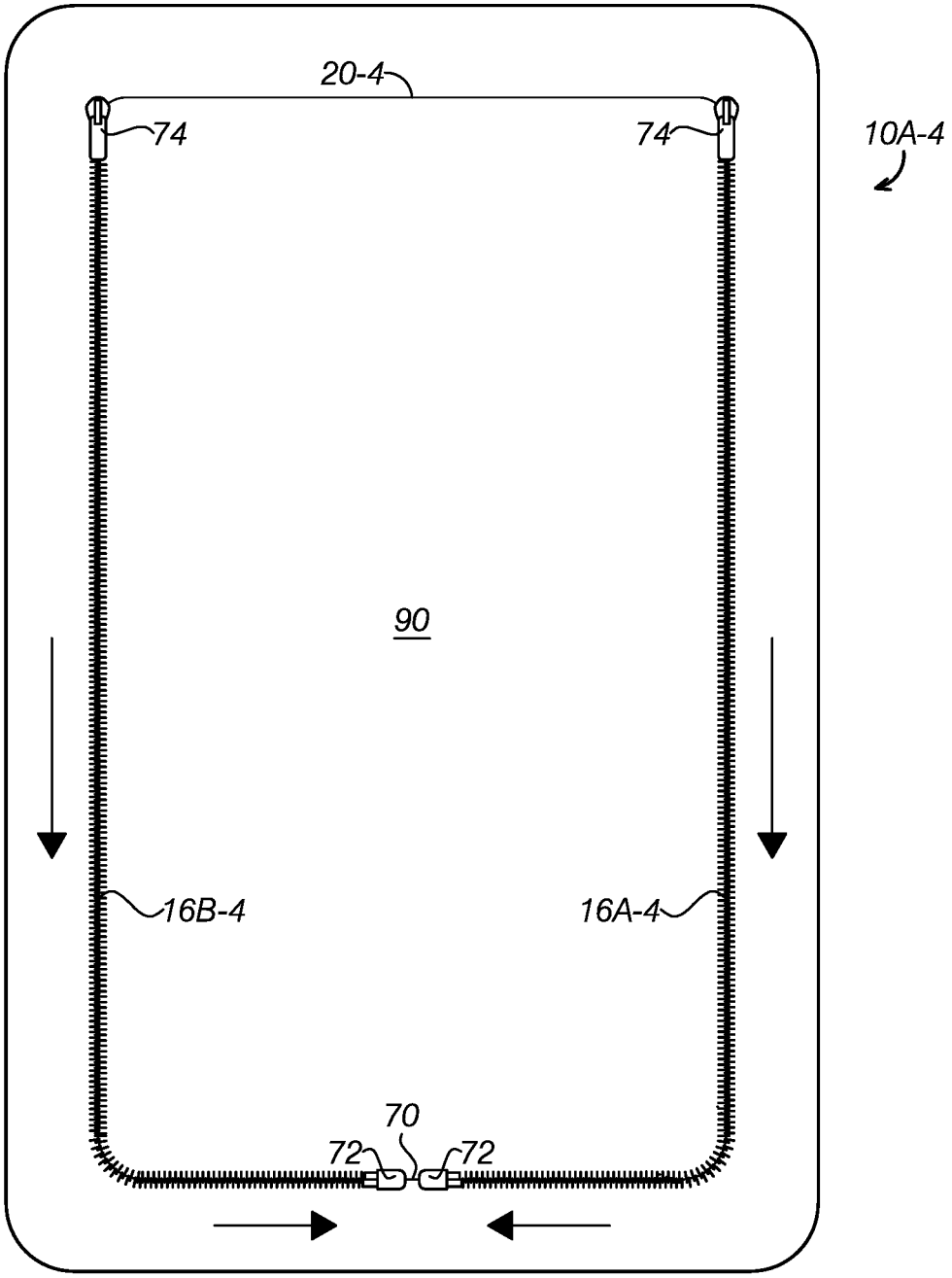
FIG. 13B is a top view of a fitted blanket having a removable center portion with a double zipper extending to an upper end of each side thereof, according to an exemplary embodiment of the present invention.

Referring now to FIGS. 13A and 13B, a single zipper design (FIG. 13A) and a dual zipper design (FIG. 13B) are shown. In these embodiments, the zipper (side opening 16-4 in FIG. 13A or side openings 16A-4 and 16B-4 in FIG. 13B) is formed to extend from the opening 20-4 at the head end of the bedding 10-4. The opening 20-4 may be a slit at the head end of the bedding 10-4 as shown in the Figures. When completely unzipped, the center portion 90 may be removed from the rest of the bedding 10-4, as described above.

As described in the above embodiments, the zipper may start and end in various locations and may not be limited to the specific locations shown in the Figures.

As previously discussed, the above refers to a zipper that is used to open and closed the side openings 16-4, 16A-4 and 16B-4. While a zipper is shown and described, other connectors are contemplated within the scope of the present invention.

In each of the above embodiments of FIGS. 10A through 13B, the center portion 90 may be removable and reattachable to the exterior portion. In some embodiments, the center portion 90 may be reversible, allowing either side to be viewable when disposed on the mattress. The center portion 90 may be formed from the same fabric as the exterior portion or may be formed from a different material or set of materials. For example, the center portion 90 may be formed similar to a sheet, a comforter, a blanket or the like.

In some embodiments, the shape of the center portion 90 may be different from the shape of the side openings 16-4. For example, the center portion 90 may have a connector (such as a zipper) that matches the shape of the exterior portion, but the actual center portion 90 may extend beyond the shape of the connector on the exterior portion along some or all of the connector.

The bedding 10, 10-2, 10-3, 10-4, 10A-4 may be designed as a blanket system, including multiple top covers. For example, the blanket system may include a fitted blanket, made of thin sheet material, such as cotton, and may further include a warmer blanket, such as a comforter, attachable thereto. Items or appendages may be attached or detached to the blanket via Velcro® or other similar securing mechanism. The blanket may be reversible and may also include accessories that may be attached to add additional appeal. Such accessories may include, for example, glow in the dark items, such as glow in the dark zippers, borders, or other accessories. The blanket could include illuminating features, such as lights (for example, light emitting diodes (LEDs))

disposed at various locations in the blanket. The blanket may be embossed with various logos, emblems or the like, such as superheroes, sports teams, cartoon characters, and the like.

The blanket may be placed on top of a conventional fitted sheet that is disposed on a mattress. In some embodiments the blanket of the present invention may be a multi-layer blanket, providing a fitted sheet built into the blanket, so that when a user enters the bedding, the user lies on top of the fitted sheet and covers up with a blanket. The fitted sheet portion may be attached to the fitted blanket by various methods. For example, the fitted sheet portion may be attached to the fitted blanket via a hook and loop fastener (such as Velcro®), stitching, zipper, snaps, or the like.

Figure 14:
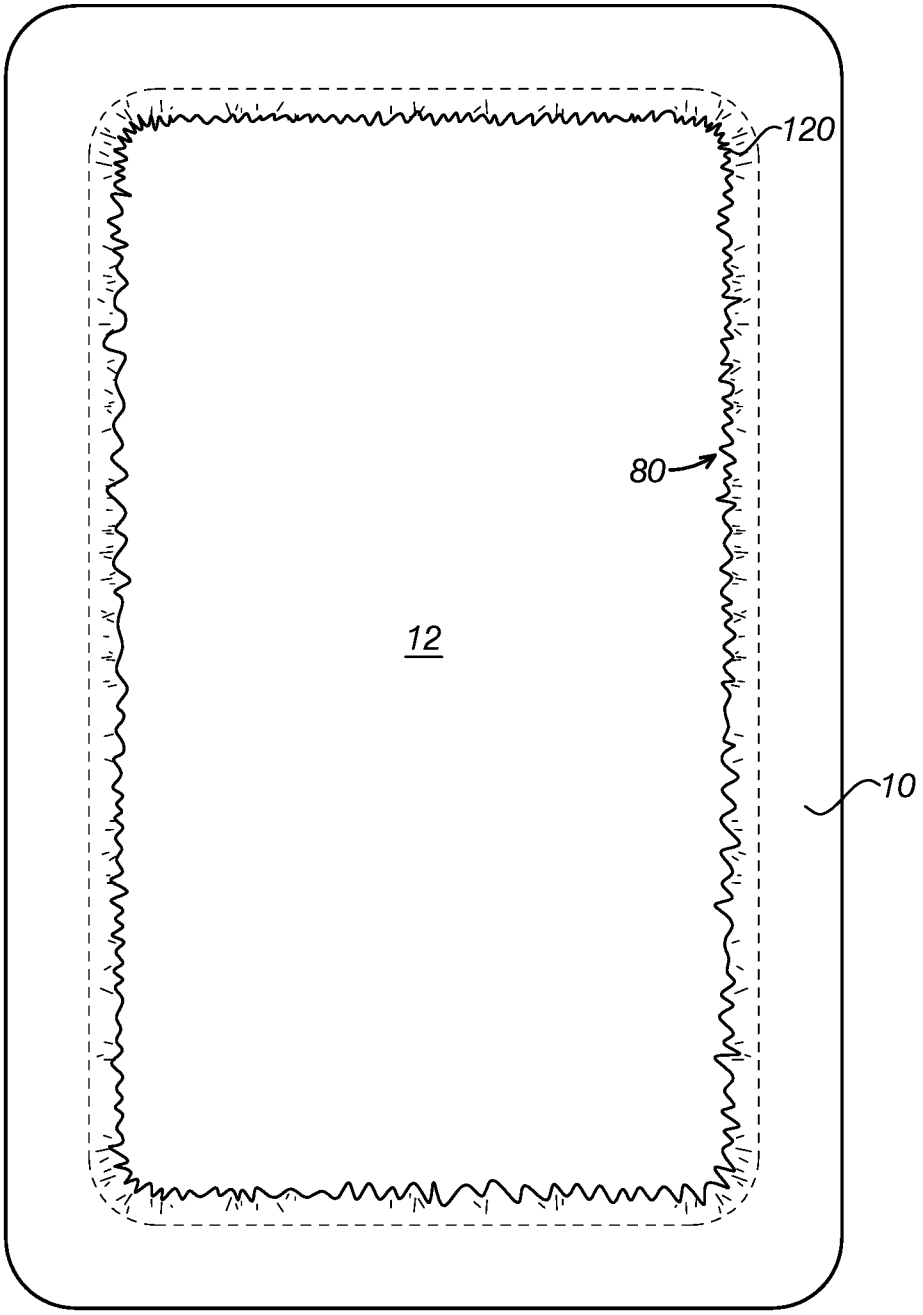
FIG. 14 is a bottom view of a fitted blanket attached to a mattress, where a sheet is attached to the fitted blanked and disposed between the fitted blanket and the mattress.
Figure 15:
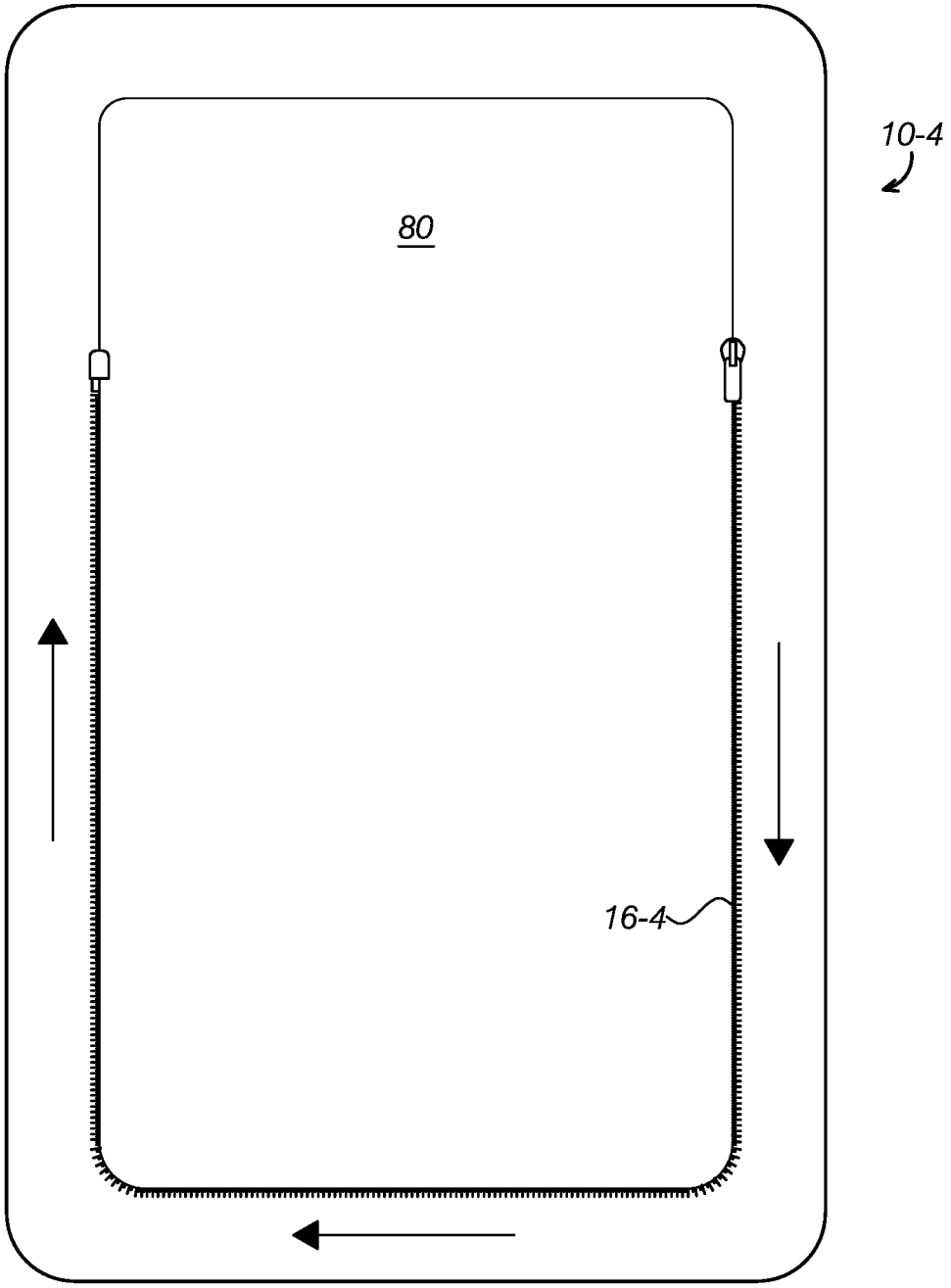
FIG. 15 is a top view of a fitted blanket of FIG. 14 having a removable center portion, with the removable center portion removed to show the sheet attached thereunder.

FIG. 14 shows one example of such a connection (shown in a dashed line) at the underside of the mattress when the blanket is positioned thereupon. However, the connection may be formed at the underside, as shown, or along the sides of the mattress. FIG. 15 shows how the attached fitted sheet portion 80 may be visible when the removable center portion is removed from the blanket 10. It should be noted that, in FIG. 15, the zipper pull 74 (see FIG. 13B) remains on the exterior portion of the bedding when the center portion 90 (see FIGS. 10A through 13B) is removed. However, in some embodiments, the zipper pull 74 may remain with the center portion 90 upon removal from the exterior portion.

The bedding 10 may be made from various fabrics, including, but not limited to cotton, silk, wool, polyester, synthetics and various blends. The bedding 10 may also include an elastic, fitted underside. The elastic can be disposed along the entire periphery of the bedding 10, or may be limited to corner regions of the bedding 10 or the like.

While the Figures show the side opening 16 running in an essentially linear manner from the head end of the mattress toward the foot end of the mattress, the side opening 16 could be formed in various shapes. For example, the side opening 16 could run in a zig-zag or arcuate manner from the head end of the mattress towards the foot end of the mattress. In some embodiments, the side opening 16 could extend generally parallel with the foot end of the mattress to create a flap that is more rectangular than triangular (as shown in the Figures).

The flaps in each of the above described embodiments may be present on one or both sides of the bedding, as well as at the head and/or foot ends thereof. The absence of a drawing showing a particular embodiment or particular combination of flaps, side openings (covered or exposed or disposed at one or more particular locations) is not meant to limit the present invention to exclude such embodiments.

In some embodiments, the blanket may be reversible, allowing a user to place the blanket with either side facing upwards. Such configuration may permit, for example, a different design to be visible on the upward facing surface of the blanket.

In some embodiments, the blanket may include heating or cooling elements that may be operable via conventional means, such as a battery, or a power source, such as standard household current. The heating or cooling mechanism may be used as desired for the comfort of the user.

It should be understood, of course, that the foregoing relates to exemplary embodiments of the invention and that modifications may be made without departing from the spirit and scope of the invention as set forth in the following claims.

What is claimed is:

1. An article of bedding comprising:

a bedding material adapted to fit on a mattress, the mattress having a head end and a foot end, the bedding material having a bedding head end and a bedding foot end and the bedding material continuously extending about an outer periphery of the mattress when the bedding material is fit on the mattress;

a head opening, formed in the bedding material, along at least a portion of the bedding head end; and at least one side opening, formed as at least one separation in the bedding material, extending toward the foot end of the mattress when the bedding material is disposed on the mattress, the side opening creating an opening, a top portion of the bedding material being defined by a portion of the bedding material separated by the opening, the opening permitting a user direct access to the mattress through the at least one side opening and under an entirety of the top portion of the bedding material, and the bedding material lying flat and unfolded on the mattress when disposed thereupon with the at least one side opening closed, wherein a first edge of the bedding material on an entirety of one side of each of the at least one separation lies adjacent a second edge of the bedding material on an entirety of the other side of each of the at least one separation when the at least one side opening is closed.

2. The article of bedding of claim 1, wherein the bedding material is a single layer of bedding material.

3. The article of bedding of claim 1, wherein the at least one side opening extends along at least one side of the mattress, along a foot end and back along an opposite side of the mattress, when the bedding material is disposed thereupon.

4. The article of bedding of claim 3, wherein the at least one side opening is a single, continuous side opening.

5. The article of bedding of claim 3, wherein the at least one side opening is two side openings.

6. The article of bedding of claim 1, wherein the side opening extends along the head opening to permit closure thereof.

7. The article of bedding of claim 3, wherein the side opening extends along the head opening to permit closure thereof.

8. The article of bedding of claim 1, wherein a center portion, defined by the at least one side opening and the head opening, is removable from an exterior portion of the article of bedding.

9. The article of bedding of claim 1, wherein the at least one side opening includes a closure to open and close the at least one side opening.

10. The article of bedding of claim 9, wherein the closure is a zipper.

11. The article of bedding of claim 1, further comprising a head opening flap covering the head opening.

12. The article of bedding of claim 1, wherein the head opening is a cut out region disposed on an upper portion of the bedding material, when the bedding material is disposed upon the mattress.

13. The article of bedding of claim 12, further comprising a head opening flap covering the cut out region.

14. The article of bedding of claim 1, wherein the side opening is disposed on at least one of a first side, a second side or a central region of the fitted bedding material.

15. The article of bedding of claim 1, further comprising at least one flap extending at least in a region adjacent the side opening toward a surface supporting the mattress.

16. An article of bedding comprising:

a bedding material adapted to fit on a mattress, the mattress having a head end and a foot end, the bedding material having a bedding head end and a bedding foot end and the bedding material continuously extending about an outer periphery of the mattress when the bedding material is fit on the mattress;

a head opening, formed in the bedding material, along at least a portion of the bedding head end;

an opening, formed as at least one separation in the bedding material, extending about a center portion of the bedding material, the side opening permitting removal and separation of the center portion from an exterior portion of the article of bedding, the center portion forming a portion of a top layer of the article of bedding when the article of bedding is assembled on the mattress, wherein a first edge of the bedding material on an entirety of one side of each of the at least one separation lies adjacent a second edge of the bedding material on an entirety of the other side of each of the at least one separation when the at least one opening is closed.

17. The article of bedding of claim 1, wherein the at least one side opening includes a closure to close the at least one side opening continuously, without breaks therealong.

18. The article of bedding of claim 1, wherein:

the at least one side opening extends along at least one side of the mattress, along a foot end and back along an opposite side of the mattress, when the bedding material is disposed thereupon; and a center portion, defined by the at least one side opening and the head opening, is removable from an exterior portion of the article of bedding.

19. The article of bedding of claim 18, wherein the opening extends along the head opening.

20. The article of bedding of claim 19, wherein a connector is disposed about the opening to removably connect the center portion to the exterior portion.

21. An article of bedding comprising:

a bedding material adapted to fit on a mattress, the mattress having a head end and a foot end, the bedding material having a bedding head end and a bedding foot end when the bedding material is fit on the mattress;

an elastic material disposed about a peripheral edge of the bedding material;

a head opening, formed in the bedding material, along at least a portion of the bedding head end; and at least one side opening, formed in the bedding material, extending toward the foot end of the mattress when the bedding material is disposed on the mattress, the side opening creating an opening, a top portion of the bedding material being defined by a portion of the bedding material separated by the opening, the opening permitting a user direct access to the mattress through the at least one side opening and under an entirety of the top portion of the bedding material, and the bedding material lying flat and unfolded on the mattress when disposed thereupon with the at least one side opening closed, wherein a first edge of the bedding material on an entirety of one side of each of the at least one side opening lies adjacent a second edge of the bedding material on an entirety of the other side of each of the at least one side opening when the at least one side opening is closed.

22. The article of bedding of claim 21, wherein the bedding material is a single layer of bedding material.

23. The article of bedding of claim 21, wherein the at least one side opening extends along at least one side of the mattress, along a foot end and back along an opposite side of the mattress, when the bedding material is disposed thereupon.

24. The article of bedding of claim 23, wherein the at least one side opening is a single, continuous side opening.

25. The article of bedding of claim 21, wherein the side opening extends along the head opening to permit closure thereof.

26. The article of bedding of claim 21, wherein a center portion, defined by the at least one side opening and the head opening, is removable from an exterior portion of the article of bedding.

* * * * *